US009098003B2

(12) United States Patent
Masumoto et al.

(10) Patent No.: US 9,098,003 B2
(45) Date of Patent: Aug. 4, 2015

(54) TONER

(75) Inventors: Akane Masumoto, Yokohama (JP); Hitoshi Itabashi, Yokohama (JP); Takashi Kenmoku, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/115,867

(22) PCT Filed: May 17, 2012

(86) PCT No.: PCT/JP2012/063240

§ 371 (c)(1), (2), (4) Date: Nov. 5, 2013

(87) PCT Pub. No.: WO2012/157781

PCT Pub. Date: Nov. 22, 2012

(65) Prior Publication Data

US 2014/0072908 A1 Mar. 13, 2014

(30) Foreign Application Priority Data

May 18, 2011 (JP) ..... 2011-111719

(51) Int. Cl.
*G03G 9/00* (2006.01)
*G03G 9/097* (2006.01)
*G03G 9/087* (2006.01)

(52) U.S. Cl.
CPC ..... *G03G 9/09775* (2013.01); *G03G 9/08791* (2013.01); *G03G 9/08795* (2013.01); *G03G 9/08797* (2013.01); *G03G 9/09733* (2013.01)

(58) Field of Classification Search
CPC ..... G03G 9/097
USPC ..... 430/108.01, 108.03, 108.04, 108.2
See application file for complete search history.

(56) References Cited

U.S. PATENT DOCUMENTS

| | | | | |
|---|---|---|---|---|
| 5,766,814 | A | 6/1998 | Baba et al. | |
| 5,985,502 | A | 11/1999 | Ayaki et al. | |
| 6,106,990 | A | 8/2000 | Tazawa et al. | |
| 6,124,070 | A | 9/2000 | Baba et al. | |
| 6,358,658 | B1 | 3/2002 | Tazawa et al. | |
| 6,566,028 | B2 | 5/2003 | Itabashi et al. | |
| 6,808,855 | B2 | 10/2004 | Ayaki et al. | |
| 7,252,917 | B2 | 8/2007 | Ohno et al. | |
| 7,323,282 | B2 | 1/2008 | Ohno et al. | |
| 7,682,765 | B2 | 3/2010 | Sugawa et al. | |
| 7,718,338 | B2 | 5/2010 | Fujimoto et al. | |
| 8,574,801 | B2 | 11/2013 | Itabashi et al. | |
| 8,609,312 | B2 | 12/2013 | Itabashi et al. | |
| 2011/0159425 | A1 | 6/2011 | Itabashi et al. | |
| 2012/0295191 | A1 * | 11/2012 | Itabashi et al. | 430/108.4 |
| 2014/0087299 | A1 | 3/2014 | Kenmoku et al. | |
| 2014/0106272 | A1 | 4/2014 | Kenmoku et al. | |

FOREIGN PATENT DOCUMENTS

| | | | |
|---|---|---|---|
| JP | 3-105355 | A | 5/1991 |
| JP | 4-16858 | A | 1/1992 |
| JP | 8-30017 | A | 2/1996 |
| JP | 2694572 | B2 | 12/1997 |
| JP | 2006-309195 | A | 11/2006 |
| JP | 2008-304723 | A | 12/2008 |
| JP | 2009-186725 | A | 8/2009 |
| JP | 2010-185907 | A | 8/2010 |

OTHER PUBLICATIONS

European Search Report dated Sep. 18, 2014 in European Application No. 12785263.0.

PCT International Search Report and Written Opinion of the International Searching Authority, International Application No. PCT/JP2012/063240, Mailing Date Jul. 31, 2012.

* cited by examiner

*Primary Examiner* — Thorl Chea

(74) *Attorney, Agent, or Firm* — Fitzpatrick, Cella, Harper and Scinto

(57) ABSTRACT

A toner including toner particles containing a binder resin, a colorant and a charge controlling agent, wherein the charge controlling agent is a polymer A having a structure "a" represented by formula (1), and the polymer A has a weight average molecular weight (Mw) of 1,000 to 100,000:

Formula (1)

wherein $R^1$ represents a hydroxyl group, a carboxyl group, an alkyl group having 1 to 18 carbon atoms, or an alkoxyl group having 1 to 18 carbon atoms, $R^2$ represents a hydrogen atom, a hydroxyl group, an alkyl group having 1 to 18 carbon atoms, or an alkoxyl group having 1 to 18 carbon atoms, and g represents an integer of 1 to 3 and h represents an integer of 0 to 3, wherein when h is 2 or 3, $R^1$ can be each independently selected.

8 Claims, 2 Drawing Sheets

TONER

TECHNICAL FIELD

The present invention relates to a toner for developing an electrostatically charged image in image forming methods such as electrophotography and electrostatic printing, or a toner for forming a toner image in a toner jet image forming method.

BACKGROUND ART

Studies for improving the triboelectric charging property of a toner are actively performed. In particular, for reasons such as environmental consciousness, requirements for more stable chargeability, and production cost, use of a resin having a charge controlling function (charge controlling resin) as a toner raw material has been recently proposed. For example, a toner in which a resin containing a salicylic acid structure is used as a charge controlling resin has been proposed (Patent Literature 1). According to such a method, a toner having an improved sublimation property of salicylic acid and a favorable charging property is obtained.

Recently, demands for a toner that can be fixed at a lower temperature have been increased, and a toner that melts at a low temperature has been developed. On the other hand, due to the effects of global warming, there has also been a demand for an enhancement in storage resistance at a higher temperature and a higher humidity. Under such circumstances, there have been problems that the above charge controlling resin is easily affected by moisture absorption and softening at a high temperature and a high humidity and has a decreased fluidity particularly for use in the toner that melts at a low temperature, and thus there has been room for improvement. Therefore, there has been a demand for developing a toner that can retain sublimation property and favorable charging property and also suppress moisture absorption and softening at a high temperature and a high humidity.

It has also been revealed that charging performance (in particular, charging rise performance at the initial stage) is insufficient in the case where a process speed is made higher in a contact one-component developing system or the like. Against such a phenomenon, there has been a demand for a toner to be quick in rise of charging to a sufficient charge amount in a short time, and there has been a demand for a toner that can achieve the above demand.

CITATION LIST

Patent Literature

PTL1: Japanese Patent Publication No. 2,694,572

SUMMARY OF INVENTION

Technical Problem

As described above, in the toner obtained by using the resin containing a salicylic acid structure as the charge controlling resin, that has been previously reported, moisture absorption and softening have been promoted at a high temperature and a high humidity, and fluidity has been decreased. In addition, triboelectric charging rise performance at the initial stage has been insufficient, and thus it has been difficult to quickly reach a sufficient triboelectric charge amount.

Solution to Problem

The present inventors have intensively studied, and as a result, have found that the above problems are solved by a toner of the present invention and thus have led to the present invention.

That is, the present invention relates to a toner including toner particles, each of which contains a binder resin, a colorant and a charge controlling agent. In the toner, the charge controlling agent is a polymer A having a structure "a" represented by formula (1), and the polymer A has a weight average molecular weight (Mw) of not less than 1,000 and not more than 100,000.

Formula (1)

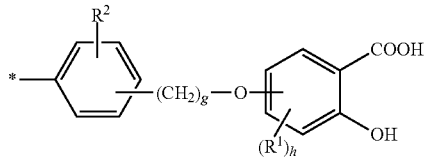

wherein $R^1$ represents a hydroxyl group, a carboxyl group, an alkyl group having not less than 1 and not more than 18 carbon atoms, or an alkoxyl group having not less than 1 and not more than 18 carbon atoms, $R^2$ represents a hydrogen atom, a hydroxyl group, an alkyl group having not less than 1 and not more than 18 carbon atoms, or an alkoxyl group having not less than 1 and not more than 18 carbon atoms, g represents an integer of not less than 1 and not more than 3 and h represents an integer of not less than 0 and not more than 3, wherein when h is 2 or 3, $R^1$ can be each independently selected, and

* represents a binding site in the polymer A.

Advantageous Effects of Invention

According to the present invention, a toner can be provided which has such favorable triboelectric charging property that rises to a sufficient charge amount in a short time and which can suppress a decrease in the fluidity of the toner even in the case where the toner is stored at a high temperature and a high humidity.

Further features of the present invention will become apparent from the following description of exemplary embodiments with reference to the attached drawings.

DESCRIPTION OF EMBODIMENTS

Figure 1:
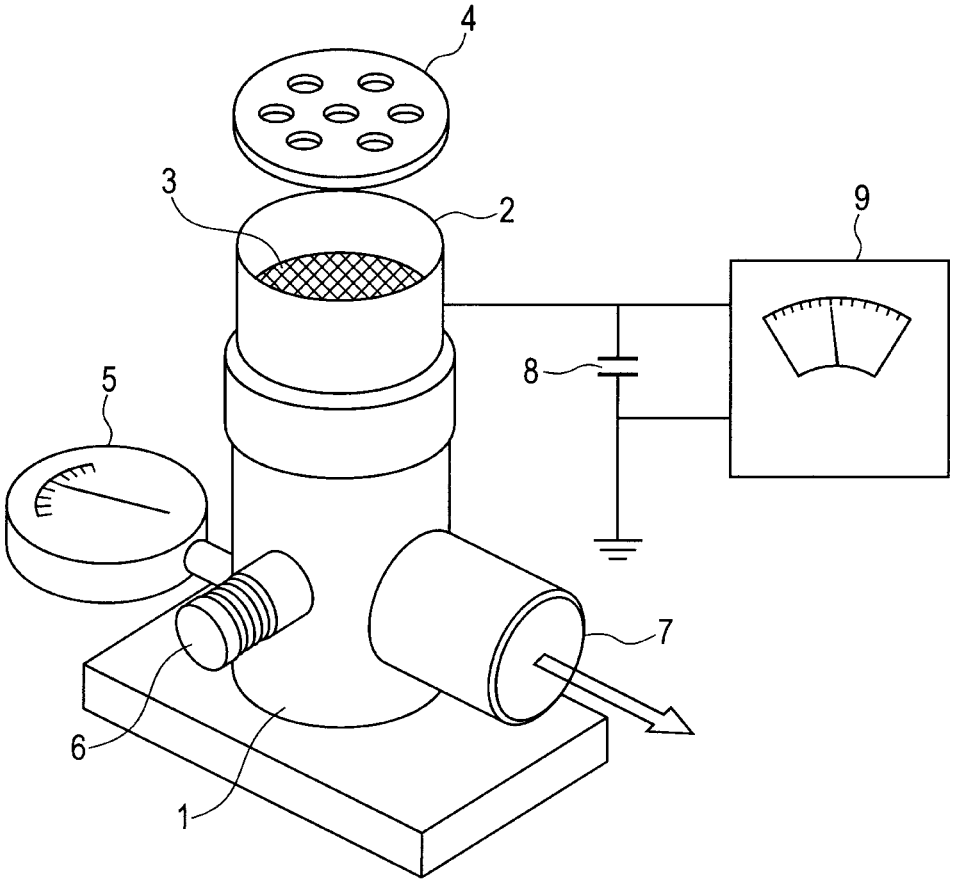
FIG. 1 illustrates a measurement apparatus for measuring a charge amount in the present invention.

Hereinafter, the present invention will be described in detail.

The present inventors have found that a polymer A having a structure "a" represented by the following formula (1) as a charge controlling agent for toners can be used to suppress a decrease in the fluidity of the toner even in the case where the toner is stored at a high temperature and a high humidity:

Formula (1)

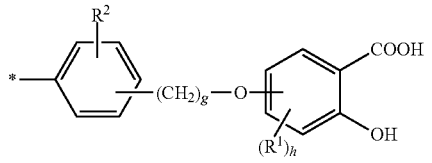

wherein $R^1$ represents a hydroxyl group, a carboxyl group, an alkyl group having not less than 1 and not more than 18 carbon atoms, or an alkoxyl group having not less than 1 and not more than 18 carbon atoms, $R^2$ represents a hydrogen atom, a hydroxyl group, an alkyl group having not less than 1 and not more than 18 carbon atoms, or an alkoxyl group having not less than 1 and not more than 18 carbon atoms, g represents an integer of not less than 1 and not more than 3 and h represents an integer of not less than 0 and not more than 3, wherein when h is 2 or 3, $R^1$ can be each independently selected, and

* represents a binding site in the polymer A.

Examples of the alkyl group in $R^1$ and $R^2$ include a methyl group, an ethyl group, a propyl group, an isopropyl group, a butyl group, an isobutyl group, a s-butyl group and a t-butyl group. Examples of the alkoxyl group in $R^1$ and $R^2$ include a methoxy group, an ethoxy group and a propoxy group.

The polymer A is a polymer in which the structure "a" is linked at the * portion. The toner obtained by using the polymer A as the charge controlling agent can suppress a decrease in the fluidity of the toner even in the case where the toner is stored at a high temperature and a high humidity, as compared with the case of using the conventional resin having a salicylic acid structure. The structure "a" is characterized by having a benzyloxy site interposed between a portion linked to the main chain and a salicylic acid structure site, and is rich in structural flexibility. Such a structure is considered to generate the effect of easily adopting a molecular configuration having an advantage in charge transmitting and receiving, thereby leading to an increase in the saturated charge amount, as compared with the conventional resin having a salicylic acid structure.

The main chain structure of the polymer A is not particularly limited as long as the structure is a structure that the structure "a" can be linked at the * portion. Examples of such a structure include a vinyl-based polymer, a polyester-based polymer, a polyamide-based polymer, a polyurethane-based polymer and a polyether-based polymer, and also a hybrid-type polymer in which two or more of the above polymers are combined. Among the above polymers, in light of ease of production, cost advantage, and affinity with a binder resin, a polyester-based polymer or a vinyl-based polymer is preferable, and a vinyl-based polymer having the structure "a" as a partial structure represented by the following formula (2) is more preferable:

Formula (2)

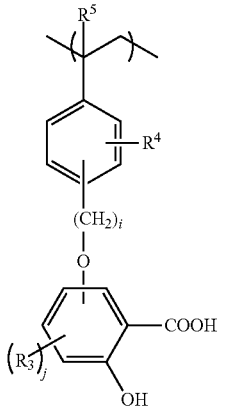

wherein $R^3$ represents a hydroxyl group, a carboxyl group, an alkyl group having not less than 1 and not more than 18 carbon atoms, or an alkoxyl group having not less than 1 and not more than 18 carbon atoms, $R^4$ represents a hydrogen atom, a hydroxyl group, an alkyl group having not less than 1 and not more than 18 carbon atoms, or an alkoxyl group having not less than 1 and not more than 18 carbon atoms $R^5$ represents a hydrogen atom or a methyl group, i represents an integer of not less than 1 and not more than 3 and j represents an integer of not less than 0 and not more than 3, wherein when j is 2 or 3, $R^3$ can be each independently selected.

Examples of the alkyl group in $R^3$ and $R^4$ include a methyl group, an ethyl group, a propyl group, an isopropyl group, a butyl group, an isobutyl group, a s-butyl group and a t-butyl group. Examples of the alkoxyl group in $R^3$ and $R^4$ include a methoxy group, an ethoxy group and a propoxy group. As described here, the polymer A is a vinyl-based polymer, so that the polymer A is compatible with toner particles having a vinyl-based resin as a main component. Such compatibilization enables a more optimal molecular configuration to be adopted, thereby more effectively exerting the charging ability of the polymer A. In the case of producing the toner in an aqueous medium, such an effect is further exerted and thus smoothly promotes the arrangement of the polymer A component having a high polarity on the surface layer of the toner particle to thereby make a particle size distribution favorable.

The molecular weight of the polymer A is calculated by Gel Permeation Chromatography (GPC) to be found that the weight average molecular weight is not less than 1,000 and not more than 100,000. If the molecular weight of the polymer A is within the above range, triboelectric charging property can be improved without having a large impact on the fixability of the toner. The weight average molecular weight can be controlled within the above range by changing the conditions such as amounts of reagents, reaction temperature and concentration of a solvent in producing the polymer A. The polymer A having a desired molecular weight can be obtained by being taken by GPC.

The content of the structure "a" in the polymer A can be not less than 10 μmol/g and not more than 1500 μmol/g. If the content of the structure "a" in the polymer A is within the above range, triboelectric charging property and favorable dispersibility in the binder resin can be achieved at the same time. The content within the above range also enables suppressing the impact of moisture absorbency possessed by the structure "a" to a small extent. The content of the structure "a" in the polymer A can be regulated by the reaction conditions such as charged amounts and reaction temperature in synthesizing the polymer A.

A method for producing the polymer A in the present invention is not particularly limited and the polymer A can be produced by any known procedure. In the case where the polymer A is a vinyl-based polymer, one example of the method is a method for copolymerizing a polymerizable monomer (formula (5)) containing the structure "a" having the structure represented by the formula (1) with a vinyl-based monomer by using a polymerization initiator:

Formula (5)

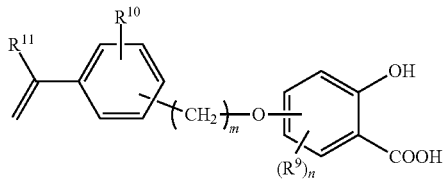

wherein $R^9$ represents a hydroxyl group, a carboxyl group, an alkyl group having not less than 1 and not more than 18 carbon atoms, or an alkoxyl group having not less than 1 and not more than 18 carbon atoms, $R^{10}$ represents a hydrogen atom, a hydroxyl group, an alkyl group having not less than 1 and not more than 18 carbon atoms, or an alkoxyl group having not less than 1 and not more than 18 carbon atoms $R^{11}$ represents a hydrogen atom or a methyl group, and m represents an integer of not less than 1 and not more than 3 and n represents an integer of not less than 0 and not more than 3, wherein when n is 2 or 3, $R^9$ can be each independently selected.

Specific examples of the polymerizable monomer containing the structure "a" are shown in Table 1.

TABLE 1

| Polymerizable monomer | Structural formula | R9 H, OH, COOH, or alkyl group or alkoxyl group having not less than 1 and not more than 18 carbon atoms | R10 H, OH, COOH, or alkyl group or alkoxyl group having not less than 1 and not more than 18 carbon atoms | R11 H or methyl group | m 1 to 3 | n 1 to 3 |
|---|---|---|---|---|---|---|
| M-1 | 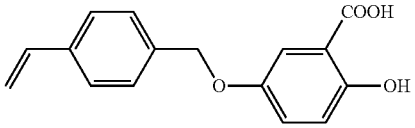 | H | H | H | 1 | 1 |
| M-2 | 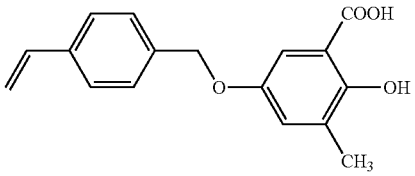 | 3-Me | H | H | 1 | 1 |
| M-3 | 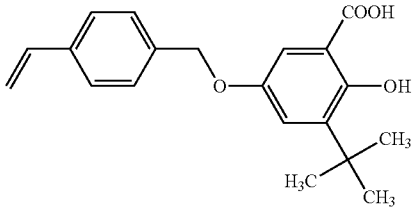 | 3-tert-Butyl | H | H | 1 | 1 |
| M-4 | 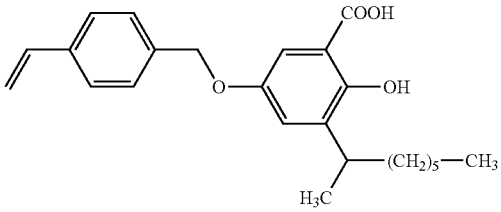 | 3-iso-Octyl | H | H | 1 | 1 |
| M-5 | 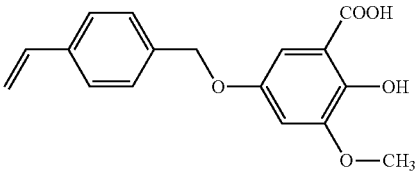 | 3-MeO | H | H | 1 | 1 |
| M-6 | 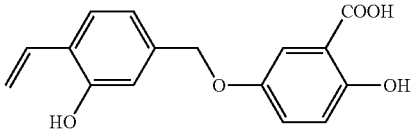 | H | 3-OH | H | 1 | 1 |
| M-7 | 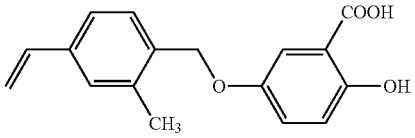 | H | 2-Me | H | 1 | 1 |

TABLE 1-continued

| Polymerizable monomer | Structural formula | R9 H, OH, COOH, or alkyl group or alkoxyl group having not less than 1 and not more than 18 carbon atoms | R10 H, OH, COOH, or alkyl group or alkoxyl group having not less than 1 and not more than 18 carbon atoms | R11 H or methyl group | m 1 to 3 | n 1 to 3 |
|---|---|---|---|---|---|---|
| M-8 | 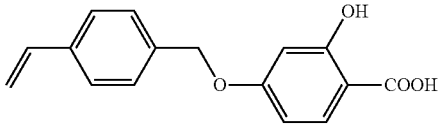 | H | H | H | 1 | 1 |
| M-9 | 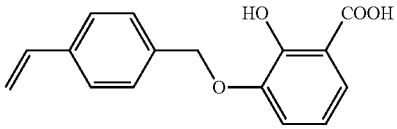 | H | H | H | 1 | 1 |
| M-10 | 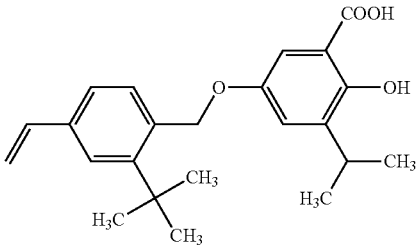 | 3-iso-Propyl | 2-tert-Butyl | H | 1 | 1 |
| M-11 | 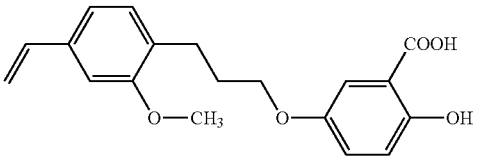 | H | 2-MeO | H | 1 | 3 |

The vinyl-based monomer to be copolymerized with the polymerizable monomer A containing the structure "a" is not particularly limited. Specifically, the vinyl-based monomer includes styrenes and derivatives thereof such as styrene, o-methylstyrene, m-methylstyrene, p-methylstyrene and α-methylstyrene; ethylenically unsaturated monoolefins such as ethylene, propylene, butylene and isobutylene; vinyl halides such as vinyl chloride, vinylidene chloride, vinyl bromide and vinyl fluoride; vinyl esters such as vinyl acetate, vinyl propionate and vinyl benzoate; acrylic esters such as n-butyl acrylate and 2-ethylhexyl acrylate; methacrylic esters in which acrylic moieties in the acrylic esters are changed to methacrylic moieties; methacrylic amino esters such as dimethylaminoethyl methacrylate and diethylaminoethyl methacrylate; vinyl ethers such as vinyl methyl ether and vinyl ethyl ether; vinyl ketones such as vinyl methyl ketone; N-vinyl compounds such as N-vinylpyrrole; vinylnaphthalenes; and acrylic or methacrylic acid derivatives such as acrylonitrile, methacrylonitrile and acrylamide. Herein, as the vinyl-based monomer, two or more of the above monomers may be used in combination, as required.

The polymerization initiator that can be used in copolymerizing the above polymerizable monomer component includes a variety of initiators such as a peroxide-based polymerization initiator and an azo-based polymerization initiator. The usable peroxide-based polymerization initiator includes organic initiators such as peroxyester, peroxydicarbonate, dialkyl peroxide, peroxyketal, ketone peroxide, hydroperoxide and diacyl peroxide; and inorganic initiators such as persulfate and hydrogen peroxide. Specifically, the initiator includes peroxyesters such as t-butyl peroxyacetate, t-butyl peroxypivarate, t-butyl peroxyisobutyrate, t-hexyl peroxyacetate, t-hexyl peroxypivarate, t-hexyl peroxyisobutyrate, t-butyl peroxyisopropyl monocarbonate and t-butyl peroxy-2-ethylhexyl monocarbonate; diacyl peroxides such as benzoyl peroxide; peroxydicarbonates such as diisopropyl peroxydicarbonate; peroxyketals such as 1,1-di-t-hexylperoxycyclohexane; dialkyl peroxides such as di-t-butyl peroxide; and others such as t-butyl peroxyallylmonocarbonate. Examples of the usable azo-based polymerization initiator include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, azobisisobutyronitrile and dimethyl-2,2'-azobis(2-methylpropionate).

Two or more kinds of the above polymerization initiators can also be used at the same time. The amount of the polymerization initiator to be used herein can be not less than 0.100 parts by mass and not more than 20.0 parts by mass based on 100 parts by mass of the polymerizable monomer. As a polymerization method, any of methods such as solution polymerization, suspension polymerization, emulsion polymerization, dispersion polymerization, precipitation polymerization and bulk polymerization can be used without any particular limitations.

On the other hand, in the case where the polymer A containing the structure "a" in the present invention is a polyester resin, a variety of known production methods are available. Examples of such methods include:

i) a method in which reaction residues of carboxyl groups and hydroxyl groups contained in a polyester structure are used and converted by an organic reaction into the structure "a" represented by the formula (1);

ii) a method in which polyester is produced using a polyhydric alcohol or a polyvalent carboxylic acid having the structure "a" represented by the formula (1) as a substituent; and iii) a method in which a functional group that easily introduces the structure "a" represented by the formula (1) as a substituent is introduced into a polyhydric alcohol or a polyvalent carboxylic acid in advance.

In addition, in the case where the polymer A is a hybrid resin, examples of a production method therefor include:

iv) a method in which a polyester resin containing the structure "a" represented by the formula (1) as a substituent is hybridized by a vinyl monomer;

v) a method in which a vinyl monomer having a carboxyl group such as acrylic acid and methacrylic acid is polymerized, and the carboxyl group is converted into the structure "a" represented by the formula (1) by an organic reaction; and vi) a method in which a polyester resin is hybridized using a vinyl monomer having the structure "a" represented by the formula (1).

Any known method can be utilized as the method for hybridizing a polyester resin with a vinyl monomer and is effective as the method iv). Specifically, any known method includes a method for performing vinyl modification of polyester by a peroxide-based initiator and a method for performing graft modification of a polyester resin having an unsaturated group to produce a hybrid resin.

Alternatively, a specific method for v) can include, in the case of introducing the structure "a" represented by the formula (1), a method for amidating a carboxyl group present in the resin by using a compound having an amino group introduced into the * portion in the formula (1).

Alternatively, in a specific method for vi), the polymerizable monomer represented by the above formula (5) can be used as the usable vinyl monomer.

In the present invention, any known method can be used as a method for adjusting the weight average molecular weight of a polymer. Specifically, in the case where the polymer is a polyester resin, the weight average molecular weight can be appropriately adjusted by adjusting the charged amounts of an acid component and an alcohol component and the polymerization period. In the case where the polymer is a hybrid resin, the weight average molecular weight can be adjusted by adjusting not only the molecular weight of a polyester component but also the molecular weight of a vinyl-modified unit. Specifically, the weight average molecular weight can be appropriately adjusted by adjusting the amount of a radical initiator, the reaction temperature, and the like in the reaction step of the vinyl modification. The above vinyl-based monomer can be used as a vinyl monomer that can be used for hybridizing a polyester resin in the present invention.

The content of the structure "a" in the polymer A can be determined by a method described below: first, titrating the polymer A by a method described below to determine the hydroxyl value of the polymer A, and calculating the amount of a hydroxyl group derived from the structure "a" contained in the polymer; and then, calculating the content (mmol/g) of the structure "a" in the polymer A based on the amount. Herein, in the case where the polymer A has a hydroxyl group at a site other than the structure "a", the hydroxyl value of a compound (e.g., polyester resin) immediately before being subjected to the addition reaction of the structure "a" in producing the polymer A is previously measured. The amount of the structure "a" to be added can be calculated as the difference between the previously measured hydroxyl value and the hydroxyl value of the polymer A after the addition reaction.

In the toner of the present invention, the content x of the structure "a" in the toner can be not less than 0.10 μmol/g and not more than 200 μmol/g. If the content x of the structure "a" in the toner is within the above range, a sufficient charge amount can be obtained and also moisture absorption can be suppressed. The content x of the structure "a" in the toner can be controlled by regulating the charged amount of the polymer A and the content of the structure "a" in the polymer A in producing the toner.

The present inventors have further found that the incorporation of a polymer B having a structure "b" (the following formula (3)) as the charge controlling agent with the polymer A is effective for an increase in the saturated charge amount and for an improvement in the charging rise performance:

Formula (3)

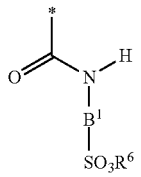

wherein $B^1$ represents an alkylene structure that may have a substituent and that has 1 or 2 carbon atoms, or an aromatic ring that may have a substituent, $R^6$ represents a hydrogen atom or an alkyl group having not less than 1 and not more than 12 carbon atoms, the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms, and the substituent in the aromatic ring is a hydroxyl group, an alkyl group having not less than 1 and not more than 12 carbon atoms, or an alkoxyl group having not less than 1 and not more than 12 carbon atoms.

The structure "b" represented by the formula (3) can be contained in the polymer B as a partial structure represented by the following formula (4):

Formula (4)

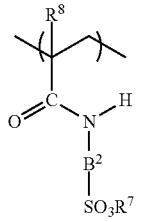

wherein $B^2$ represents an alkylene structure that may have a substituent and that has 1 or 2 carbon atoms, or an aromatic ring that may have a substituent, $R^7$ represents a hydrogen atom or an alkyl group having not less than 1 and not more than 12 carbon atoms, $R^8$ represents a hydrogen atom or a methyl group, the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms, and the substituent in the aromatic ring is a hydroxyl group, an alkyl group having not less than 1 and not more than 12 carbon atoms, or an alkoxyl group having not less than 1 and not more than 12 carbon atoms.

A method for producing the polymer B is not particularly limited and the polymer B can be produced by the same method as the method for the polymer A. In the case where the polymer B is a vinyl-based polymer, a vinyl monomer represented by a formula (6) can be used:

Formula (6)

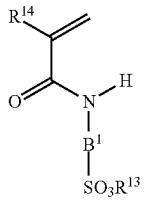

wherein $B^1$ represents an alkylene structure that may have a substituent and that has 1 or 2 carbon atoms, or an aromatic ring that may have a substituent, $R^{13}$ represents a hydrogen atom or an alkyl group having not less than 1 and not more than 12 carbon atoms, $R^{14}$ represents a hydrogen atom or a methyl group, the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms, and the substituent in the aromatic ring is a hydroxyl group, an alkyl group having not less than 1 and not more than 12 carbon atoms, or an alkoxyl group having not less than 1 and not more than 12 carbon atoms.

Specific examples of the polymer monomer B containing the structure "b" include the following: 2-acrylamide-2-methylpropanesulfonic acid, 2-acrylamidebenzenesulfonic acid, 2-methacrylamidebenzenesulfonic acid, 3-acrylamidebenzenesulfonic acid, 3-methacrylamidebenzenesulfonic acid, 4-acrylamidebenzenesulfonic acid, 4-methacrylamidebenzenesulfonic acid, 2-acrylamide-5-methylbenzenesulfonic acid, 2-methacrylamide-5-methylbenzenesulfonic acid, 2-acrylamide-5-methoxybenzenesulfonic acid, 2-methacrylamide-5-methoxybenzenesulfonic acid, and alkylesters having not less than 1 and not more than 12 carbon atoms of the above acids. The monomer is preferably a sulfonic acid structure, methyl ester or ethylester, and more preferably a sulfonic acid structure or methyl ester.

Also in the case where the polymer B is a polyester resin, a method for producing the polymer B can be used by the same method as the method for producing the polymer A. Any known method can be utilized as the method for hybridizing a polyester resin with a vinyl monomer, and is effective as the method iv) described in the example of the method for producing the polymer A. Specifically, any known method includes a method for performing vinyl modification of polyester by a peroxide-based initiator and a method for performing graft modification of a polyester resin having an unsaturated group to produce a hybrid resin.

Alternatively, a specific method for v) can include, in the case of introducing the structure "b" represented by the formula (3), a method for amidating a carboxyl group present in the resin by using a compound having an amino group introduced into the * portion in the formula (3).

Alternatively, in a specific method for vi), the polymerizable monomer represented by the above formula (6) can be used as the usable vinyl monomer.

In the present invention, any known method can be used as a method for adjusting the weight average molecular weight of a polymer. Specifically, in a polyester resin, the weight average molecular weight can be appropriately adjusted by adjusting the charged ratio of an acid component and an alcohol component and the polymerization period. In a hybrid resin, not only the molecular weight of a polyester component but also the molecular weight of a vinyl-modified unit can be adjusted. Specifically, the weight average molecular weight can be appropriately adjusted by adjusting the amount of a radical initiator, the reaction temperature, and the like in the reaction step of the vinyl modification. The above vinyl-based monomer can be used as a vinyl monomer that can be used for hybridizing a polyester resin in the present invention.

The coexistence of the polymer A and the polymer B in a toner binder makes rise of charging and charging stability of the toner favorable and makes a charge amount distribution sharp. The reasons for this are not clear, but the present inventors consider as follows: while a power generation mechanism by a sulfonic acid group and a charge accumulation function by an amide group in the structure "b" increase a charging speed and make rise of charging the toner favorable, the salicylic acid structure contained in the structure "a" allows excessive charges accumulated in the structure "b" to be dissipated in the toner binder, thereby suppressing excessive charging of the toner. It is considered that such an action easily makes the charge amount distribution of the toner as a whole uniform even if each charging event with respect to one toner particle varies, thereby also making rise of charging favorable.

The polymer B is contained so that the sulfur content in the toner is 0.10 μmol/g or more, and a molar ratio, x/y, of the content x (μmol/g) of the structure "a" contained in the toner to the content y (μmol/g) of the structure "b" contained in the toner can be not less than 0.10 and not more than 50. If the sulfur content in the toner is not less than 0.10 μmol/g, a more sufficient charge amount is obtained. If the ratio x/y is within the above range, the rise of charging is effectively higher. The sulfur content in the toner can be controlled by the amount of the polymer B to be added in producing the toner, so as to be not less than 0.10 μmol/g. The ratio x/y can be controlled by regulating the amounts of the polymer A and the polymer B to be added in producing the toner and by adjusting the content x of the structure "a" in the polymer A and the content y of the structure "b" in the polymer B so as to be within the above range.

In the present invention, the sulfur content and the content y of the structure "b" in the toner particles are calculated as follows. The amount of a S element derived from the structure "b" present in 1 g of the polymer B is calculated by elemental analysis of the polymer B, and divided by 32.06 (atomic weight of S) to thereby calculate the content (μmol/g) of the structure "b" per g of the polymer B. Then, the content (μmol/g) of the structure "a" calculated from the hydroxyl value can be used to determined the molar ratio, a/b, of the structure "a" to the structure "b".

The amounts of the polymer A and the polymer B to be added are not less than 0.0100 parts by mass and not more than 50.0 parts by mass based on 100.0 parts by mass of the binder resin. The amounts are more preferably not less than 0.0100 parts by mass and not more than 30.0 parts by mass.

The binder resin to be used in the toner of the present invention is not particularly limited. Examples of the binder resin can include the following: a styrene resin, an acrylic-based resin, a methacrylic-based resin, a styrene-acrylic-based resin, a styrene-methacrylic-based resin, a polyethylene resin, a polyethylene-vinyl acetate-based resin, a vinyl acetate resin, a polybutadiene resin, a phenol resin, a polyurethane resin, a polybutyral resin, a polyester resin, and hybrid resins in which any of the above resins are combined. In particular, the following can be used in terms of toner property: a styrene-based resin, an acrylic-based resin, a methacrylic-based resin, a styrene-acrylic-based resin, a styrene-methacrylic-based resin, a polyester resin, a styrene-acrylic resin, or a hybrid resin obtained by combining a styrene-methacrylic resin and a polyester resin.

As the polyester resin, a polyester resin usually produced by using a polyhydric alcohol and a carboxylic acid, carboxylic anhydride or carboxylate as raw material monomers can be used. Specifically, the same polyhydric alcohol component and the same polyvalent carboxylic acid component as in the above polyester resin are available. In particular, the polyester resin can be a polyester resin obtained by polycondensing the following component: as a diol component, bisphenol derivatives; and as an acid component, carboxylic acid components including a di- or more carboxylic acid or an anhydride thereof, such as fumaric acid, maleic acid, maleic anhydride, phthalic acid, terephthalic acid, trimellitic acid and pyromellitic acid, or a lower alkyl ester thereof.

The toner of the present invention can also be used as a magnetic toner, and the following magnetic material is used in this case: iron oxides such as magnetite, maghemite and ferrite, or iron oxides including other metal oxide; metals such as Fe, Co and Ni, or alloys of any of these metals and any of metals such as Al, Co, Cu, Pb, Mg, Ni, Sn, Zn, Sb, Ca, Mn, Se and Ti, and mixture thereof; and triiron tetraoxide ($Fe_3O_4$), iron sesquioxide ($\gamma$-$Fe_2O_3$), iron zinc oxide ($ZnFe_2O_4$), copper iron oxide ($CuFe_2O_4$), neodymium iron oxide ($NdFe_2O_3$), barium iron oxide ($BaFe_{12}O_{19}$), iron magnesium oxide ($MgFe_2O_4$) and iron manganese oxide ($MnFe_2O_4$). These magnetic materials are used alone or two or more thereof are used in combination. The magnetic material can be particularly a fine powder of triiron tetraoxide or $\gamma$-iron sesquioxide.

These magnetic materials preferably have an average particle diameter of not less than 0.1 μm and not more than 2 μm, and more preferably not less than 0.1 μm and not more than 0.3 μm. As magnetic properties under application of 795.8 kA/m (10 kilooersteds), a coercive force (Hc) is not less than 1.6 kA/m and not more than 12 kA/m (not less than 20 oersteds and not more than 150 oersteds) and a saturation magnetization (as) is not less than 5 $Am^2/kg$ and not more than 200 $Am^2/kg$. The saturation magnetization can be not less than 50 $Am^2/kg$ and not more than 100 $Am^2/kg$, and a residual magnetization ($\sigma r$) can be not less than 2 $Am^2/kg$ and not more than 20 $Am^2/kg$.

The magnetic material may be used in an amount of not less than 10.0 parts by mass and not more than 200 parts by mass, and preferably not less than 20.0 parts by mass and not more than 150 parts by mass, based on 100 parts by mass of the binder resin.

On the other hand, as a colorant in the case where the toner of the present invention is used as a non-magnetic toner, any known colorant such as a variety of dyes and pigments conventionally known can be used.

A magenta color pigment includes C.I. Pigment Reds 3, 5, 17, 22, 23, 38, 41, 112, 122, 123, 146, 149, 178, 179, 190 and 202, and C.I. Pigment Violets 19 and 23. Such a pigment may be used alone or may be used with a dye.

A cyan color pigment includes C.I. Pigment Blues 15, 15:1 and 15:3 or a copper phthalocyanine pigment in which a phthalocyanine backbone has not less than 1 and not more than 5 phthalimidemethyl groups substituted.

A yellow color pigment includes C.I. Pigment Yellows 1, 3, 12, 13, 14, 17, 55, 74, 83, 93, 94, 95, 97, 98, 109, 110, 154, 155, 166, 180 and 185.

As a black colorant, carbon black, aniline black, acetylene black, titanium black and a colorant toned to a black color by using the above yellow/magenta/cyan colorants can be utilized.

The toner of the present invention may contain a releasing agent. The releasing agent includes aliphatic hydrocarbon-based waxes such as a low-molecular weight polyethylene, a low-molecular weight polypropylene, a microcrystalline wax and a paraffin wax; oxides of the aliphatic hydrocarbon-based waxes, such as an oxidized polyethylene wax; block copolymers such as an aliphatic hydrocarbon-based wax; waxes containing a fatty acid ester as a main component, such as a carnauba wax, sasol wax and a montan acid ester wax; agents in which a part or all of a fatty acid ester is deoxidized, such as a deoxidized carnauba wax, and partially esterified products of a fatty acid and a polyhydric alcohol, such as behenic monoglyceride; and methylester compounds having a hydroxyl group obtained by hydrogenating a vegetable oil.

The molecular weight distribution of the releasing agent preferably has the main peak at a region corresponding to a molecular weight of not less than 400 and not more than 2400, and more preferably at a region corresponding to a molecular weight of not less than 430 and not more than 2000. Thus, preferable thermal properties can be provided to the toner. The amount of the releasing agent to be added is preferably not less than 2.50 parts by mass and not more than 40.0 parts by mass in total, and more preferably not less than 3.00 parts by mass and not more than 15.0 parts by mass in total, based on 100 parts by mass of the binder resin.

A procedure for producing the toner particles can include a kneading and pulverizing method, a suspension polymerization method, a dissolution suspension method and an emulsion aggregation method. Among these methods, a suspension polymerization method, a dissolution suspension method and an emulsion aggregation method, in which the toner particles are produced in an aqueous medium, are preferable. A toner produced by the method for producing the toner particles by the suspension polymerization is more preferable. The reasons for this is because a step of granulating the toner particles in an aqueous medium (granulating step) enables effectively localizing the polymer A and/or the polymer B on the surfaces of the toner particles to thereby effectively exert uniform chargeability and a favorable particle size distribution.

In the method for producing the toner particles by the suspension polymerization method, first, the colorant is allowed to be dissolved in and mixed with or dispersed in the polymerizable monomer constituting the binder resin by a stirrer or the like. In particular, in the case where the colorant is a pigment, the colorant can be treated by a disperser to form a pigment-dispersed paste. The paste is uniformly dissolved in and mixed with or dispersed in the polymerizable monomer and the polymerization initiator, the polymer A and/or the polymer B as the charge controlling agent, and also a wax and optional other additives by a stirrer or the like to produce a polymerizable monomer composition. Herein, the polymer A and/or the polymer B may also be mixed in advance in producing the pigment paste. The thus obtained polymerizable monomer composition is added to a dispersing medium (that can be an aqueous medium) containing a dispersion stabilizer, and finely dispersed to a toner particle diameter by using a high speed disperser such as a high speed stirrer or an ultrasonic disperser as a stirring apparatus (granulating step). Then, the finely dispersed polymerizable monomer composition in the granulating step can be subjected to a polymerization reaction with light or heat (polymerization step) to obtain the toner particles.

As a method for dispersing the pigment in an organic medium, any known method can be used. For example, the resin and a pigment-dispersing agent are dissolved in an organic medium, as required, and a pigment powder is gradually added thereto with stirring and the resultant is sufficiently blended in a solvent. The pigment can be further stably finely dispersed, namely, can be dispersed in the form of uniformly fine particles by a mechanical shearing force applied by a disperser such as a ball mill, a paint shaker, a dissolver, an attritor, a sand mill, or a high speed mill.

As the polymerizable monomer that can be suitably used for the suspension polymerization method, the above vinyl-based monomer can also be used.

In the method for producing the toner particles by the suspension polymerization method, the usable dispersing medium is determined depending on solubilities of the binder resin, the organic medium, the polymerizable monomer, the polymer A, the polymer B and the like in the dispersing medium, and can be an aqueous dispersing medium. Examples of the usable aqueous dispersing medium include water; alcohols such as methyl alcohol, ethyl alcohol, modified ethyl alcohol, isopropyl alcohol, n-butyl alcohol, isobutyl alcohol, tert-butyl alcohol and sec-butyl alcohol; and ether alcohols such as methylcellosolve, cellosolve, isopropylcellosolve, butylcellosolve and diethylene glycol monobutylether. Other aqueous dispersing medium is selected from ketones such as acetone, methylethylketone and methylisobutylketone; esters such as ethyl acetate; ethers such as ethyl ether and ethylene glycol; acetals such as methylal and diethylacetal; and acids such as formic acid, acetic acid and propionic acid, and can be particularly water or alcohols. Two or more of these solvents can also be mixed before use. The concentration of the liquid mixture or the polymerizable monomer composition to the dispersing medium is preferably not less than 1% by mass and not more than 80% by mass, and more preferably not less than 10% by mass and not more than 65% by mass, relative to the dispersing medium.

As the usable dispersion stabilizer in use of the aqueous dispersing medium, any known stabilizer can be used. Specifically, such an stabilizer includes as inorganic compounds, calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica and alumina, and includes as organic compounds, polyvinyl alcohol, gelatin, methyl cellulose, methyl hydroxypropyl cellulose, ethyl cellulose, a sodium salt of carboxymethyl cellulose, polyacrylic acid and salts thereof, and starch, any of which can be used with being dispersed in an aqueous phase. The concentration of the dispersion stabilizer can be not less than 0.2 parts by mass and not more than 20.0 parts by mass based on 100 parts by mass of the liquid mixture or the polymerizable monomer composition.

As the polymerization initiator to be used for producing the toner particles by the suspension polymerization method, the above initiator can be used.

In producing the toner particles by the suspension polymerization method, any known crosslinking agent may be added. The amount of the agent to be added can be not less than 0 parts by mass and not more than 15.0 parts by mass based on 100 parts by mass of the polymerizable monomer.

In the dissolution suspension method, the toner particles can be produced by dispersing or dissolving the polymer A and/or the polymer B with other necessary components in an organic solvent, suspending and granulating the resultant in an aqueous medium, and then removing the organic solvent in droplets.

In the emulsion aggregation method, the toner particles can be produced by finely dispersing the polymer A and/or the polymer B in an aqueous medium by a method such as phase transition emulsification, mixing the resultant with fine particles of other necessary components, and aggregating the resultant in an aqueous medium by controlling their zeta potentials so as to have a toner particle diameter.

A flow improver as an external additive may be added to the toner particles.

The flow improver includes fluorinated resin powders such as a vinylidene fluoride fine powder and a polytetrafluoroethylene fine powder; silica fine powders such as a silica fine powder by a wet process and a silica fine powder by a dry process, and treated silica fine powders obtained by surface-treating the above silica fine powders with a treating agent such as a silane coupling agent, a titanium coupling agent or silicone oil; titanium oxide fine powders; alumina fine powders, treated titanium oxide fine powders, and treated aluminum oxide fine powders. The flow improver providing a favorable result has a specific surface area of 30.0 $m^2/g$ or more, preferably 50.0 $m^2/g$ or more, measured by the BET method by nitrogen adsorption. The amount of the flow improver to be added based on 100 parts by mass of the toner particles is preferably not less than 0.010 parts by mass and not more than 8.0 parts by mass, and more preferably not less than 0.10 parts by mass and not more than 4.0 parts by mass, based on 100 parts by mass of the toner particles.

In order to faithfully develop a finer latent image dot, the toner preferably has a weight average particle diameter (D4) of not less than 3.0 μm and not more than 15.0 μm, and more preferably not less than 4.0 μm and not more than 12.0 μm. The ratio, (D4/D1), of the weight average particle diameter (D4) to the number average particle diameter (D1) can be less than 1.40.

The toner of the present invention can also be mixed with a magnetic carrier to be used as a two-component-type developer. As the magnetic carrier, particles of metals such as surface-oxidized or not oxidized iron, lithium, calcium, magnesium, nickel, copper, zinc, cobalt, manganese, chromium and rare earths, alloy particles thereof, oxide particles thereof and fine particles of ferrite can be used.

In a developing method in which an alternating current bias is applied to a development sleeve, a covered carrier in which the surface of a magnetic carrier core is covered with a resin can be used. As a covering method, a method of adhering to the surface of a magnetic carrier core an applying liquid prepared by dissolving or suspending a covering material such as a resin and a method of mixing a magnetic carrier core and a covering material in the form of a powder are used.

The covering material of the magnetic carrier core includes a silicone resin, a polyester resin, a styrene-based resin, an acrylic-based resin, polyamide, polyvinylbutyral, and an aminoacrylate resin. These resins are used alone or plural. The amount of the covering material to be treated is not less than 0.10% by mass and not more than 30% by mass and more preferably not less than 0.50% by mass and not more than 20% by mass relative to carrier core particles. As the average particle diameter of the magnetic carrier, a volume-based 50% particle diameter (D50) is preferably not less than 10.0 μm and not more than 100 μm, and more preferably not less than 20.0 μm and not more than 70.0 μm. In the case of preparing the two-component-type developer, the ratio of two components to be mixed is preferably not less than 2.0% by mass and not more than 15% by mass, and more preferably not less than 4.0% by mass and not more than 13% by mass, in terms of the toner concentration in the developer.

Hereinafter, a method for measuring each physical property will be indicated.

<Molecular Weight of Resin>

The molecular weights and the molecular weight distributions of the polymer A and the polymer B are calculated by Gel Permeation Chromatography (GPC) in terms of polystyrene. Since the column eluting rate of the polymer B having a sulfonic acid group also depends on the amount of the sulfonic acid group, the precise molecular weight and molecular weight distribution are not considered to be measured. It is therefore necessary to prepare a sample whose sulfonic acid group is previously capped. Such capping can be methyl esterification, and a commercial available methyl esterifying agent can be used. Specifically, the capping includes a method of treating with trimethylsilyldiazomethane.

The molecular weight is measured by GPC as follows: the resin is added to THF (tetrahydrofuran) and left to stand at room temperature for 24 hours, and the obtained solution is filtrated by a membrane filter having a pore diameter of 0.2 μm and having solvent resistance, "MAISHORI DISK" (manufactured by TOSOH CORPORATION) to obtain a sample solution, which is measured under the following conditions. Herein, in preparing the sample, the amount of THF is adjusted so that the concentration of the resin is 0.8% by mass. It is to be noted that when the resin is hardly dissolved in THF, a basic solvent such as DMF can also be used.

Apparatus: HLC8120 GPC (detector: RI) (manufactured by TOSOH CORPORATION)

Column: Seven columns of Shodex KF-801, 802, 803, 804, 805, 806, and 807 (manufactured by Showa Denko K.K.)

Eluent: tetrahydrofuran (THF)

Flow rate: 1.0 ml/min

Oven temperature: 40.0° C.

Amount of sample to be injected: 0.10 ml

To calculate the molecular weight of the sample, a molecular weight calibration curve which is created by using a standard polystyrene resin column recited below: specifically, trade name "TSK Standard Polystyrene F-850, F-450, F-288, F-128, F-80, F-40, F-20, F-10, F-4, F-2, F-1, A-5000, A-2500, A-1000, A-500"; manufactured by TOSOH CORPORATION); is used.

<Compositional Analysis>

The following measuring apparatus can be used to determine the structures of the polymer A and the polymer B.

[FT-IR Spectrum]

AVATAR360FT-IR manufactured by Thermo Fisher Scientific Inc.

[$^{1}$H-NMR, $^{13}$C-NMR]

FT-NMR JNM-EX400 manufactured by JEOL Ltd. (solvent used: deuterochloroform)

<Method of Measuring Acid Value of Resin>

The acid value is an amount in mg of potassium hydroxide required for neutralizing an acid contained in 1 g of a sample. The acid value in the present invention is measured according to JIS K 0070-1992, and specifically, is measured according to the following procedure.

A 0.1 mol/l potassium hydroxide ethyl alcohol solution (produced by Kishida Chemical Co., Ltd.) is used for the titration. The factor of the potassium hydroxide ethyl alcohol solution can be determined by using a potentiometric titrator (manufactured by KYOTO ELECTRONICS MANUFACTURING CO., LTD. potentiometric titrator AT-510). The factor is determined by taking 100 ml of 0.100 mol/l hydrochloric acid in a 250 ml tall beaker and titrating the acid with the potassium hydroxide ethyl alcohol solution to determine the amount of the potassium hydroxide ethyl alcohol solution required for neutralizing the acid. As the 0.100 mol/l hydrochloric acid, an acid produced according to JIS K 8001-1998 is used.

The condition of measuring the acid value is shown below.

Titrator: potentiometric titrator AT-510 (manufactured by KYOTO ELECTRONICS MANUFACTURING CO., LTD.)

Electrode: composite glass electrode (double junction type) (manufactured by KYOTO ELECTRONICS MANUFACTURING CO., LTD.)

Control software for Titrator: AT-WIN

Analysis software for titration: Tview

The titration parameters and control parameters at the time of titration are set below.

Titration Parameters

Titration mode: blank titration

Titration manner: total amount titration

Maximum titration amount: 20 ml

Waiting time before titration: 30 seconds

Titration direction: Automatic

Control Parameters

Potential for endpoint determination: 30 dE

Potential difference for endpoint determination: 50 dE/dmL

Determination of endpoint detection: not set

Control speed mode: standard

Gain: 1

Data acquisition potential: 4 mV

Data acquisition titration amount: 0.1 ml

Main Test;

A measurement sample (0.100 g) is precisely weighed and charged in a 250 ml tall beaker, and 150 ml of a mixed solution of toluene/ethanol (3:1) is added thereto to dissolve the sample over 1 hour. The resultant is titrated with the potassium hydroxide ethyl alcohol solution by using the potentiometric titrator.

Blank Test;

The same titration as the above operation is performed except that the sample is not used (namely, only mixed solution of toluene/ethanol (3:1)).

The obtained result is substituted in the following equation to calculate the acid value.

$$A=[(C-B)\times f\times 5.611]/S$$

(wherein, A: acid value (mgKOH/g), B: added amount of potassium hydroxide ethyl alcohol solution in blank test (ml), C: added amount of potassium hydroxide ethyl alcohol solution in main test (ml), f: factor of potassium hydroxide solution, and S: sample (g))

<Method of Measuring Hydroxyl Value of Resin>

The hydroxyl value is an amount in mg of potassium hydroxide required for neutralizing acetic acid bound to a hydroxyl group when acetylating 1 g of the sample. The hydroxyl value in the present invention is measured according to JIS K 0070-1992, and specifically, is measured according to the following procedure.

Special grade acetic anhydride (25.0 g) is charged in a 100 ml volumetric flask, pyridine is added so that the total amount reaches 100 ml, and the resultant is sufficiently agitated to obtain an acetylating reagent. The obtained acetylating reagent is stored in a brown bin so as not to be in contact with humidity, carbon dioxide and the like.

A 1.0 mol/l potassium hydroxide ethyl alcohol solution (produced by Kishida Chemical Co., Ltd.) is used for performing the titration. The factor of the potassium hydroxide ethyl alcohol solution can be determined by using the potentiometric titrator (potentiometric titrator AT-510 manufactured by KYOTO ELECTRONICS MANUFACTURING CO., LTD.). The factor is determined by taking 100 ml of 1.00 mol/l hydrochloric acid in a 250 ml tall beaker and titrating the acid with the potassium hydroxide solution to determine the amount of the potassium hydroxide ethyl alcohol solution required for neutralizing the acid. As the 1.00 mol/l hydrochloric acid, an acid produced according to JIS K 8001-1998 is used.

The condition of measuring the hydroxyl value is shown below.

Titrator: potentiometric titrator AT-510 (manufactured by KYOTO ELECTRONICS MANUFACTURING CO., LTD.)
Electrode: composite glass electrode (double junction type) (manufactured by KYOTO ELECTRONICS MANUFACTURING CO., LTD.)
Control software for Titrator: AT-WIN
Analysis software for titration: Tview The titration parameters and control parameters at the time of titration are set below.

Titration Parameters
Titration mode: blank titration
Titration manner: total amount titration
Maximum titration amount: 80 ml
Waiting time before titration: 30 seconds
Titration direction: Automatic
Control Parameters
Potential for endpoint determination: 30 dE
Potential difference for endpoint determination: 50 dE/dmL
Determination of endpoint detection: not set
Control speed mode: standard
Gain: 1
Data acquisition potential: 4 mV
Data acquisition titration amount: 0.5 ml The pulverized measurement sample (2.00 g) is precisely weighed and charged in a 200 ml round-bottom flask, and 5.00 ml of the acetylating reagent is precisely added thereto by using a volumetric pipette. In the case where the sample is here hardly dissolved in the acetylating reagent, special grade toluene is added in a small amount to be dissolved.

A small funnel is mounted on the mouth of the flask, and the bottom portion of the flask is immersed by 1 cm in a glycerin bath at 97° C. and heated. Herein, in order to prevent the neck of the flask from being heated by the heat of the bath, the base of the neck of the flask can be covered with a cardboard sheet with a round hole made therein.

One hour later, the flask is taken out of the glycerol bath, and then left to cool. After the flask is left to cool, 1.00 ml of water is added thereto through the funnel, followed by shaking to hydrolyze acetic anhydride. In order to further hydrolyze the acetic anhydride completely, the flask is again heated in the glycerol bath for 10 minutes. After the flask is left to cool, the walls of the funnel and the flask are washed with 5.00 ml of ethyl alcohol.

The obtained sample is transferred to a 250 ml tall beaker, and 100 ml of a mixed solution of toluene/ethanol (3:1) is added thereto to dissolve the sample over 1 hour. The resultant is titrated with the potassium hydroxide ethyl alcohol solution by using the potentiometric titrator.

(B) Blank Test

The same titration as the above operation is performed except that the sample is not used.

(3) The obtained result is substituted in the following equation to calculate the hydroxyl value:

$$A=[\{(B-C)\times 28.05\times f\}/S]+D$$

wherein, A: hydroxyl value (mgKOH/g), B: added amount of potassium hydroxide ethyl alcohol solution in blank test (ml), C: added amount of potassium hydroxide ethyl alcohol solution in main test (ml), f: factor of potassium hydroxide solution, and S: sample (g), D: acid value of resin (mgKOH/g).

<Method of Measuring S Amount in Polymer B>

The molar number of the structure "b" in the polymer B corresponds to the molar number of the sulfur element in the resin. Therefore, the structure "b" is quantified by measuring the amount of the sulfur element in the resin as described below.

<Quantification of Amount of Sulfur Element in Resin>

The method for quantifying the amount of the sulfur element contained in the resin will be described below. Specifically, the resin is introduced into an automatic sample combustion apparatus (apparatus name: Pre-treating Apparatus for Ion Chromatograph, AQF-100 Model, manufactured by DIA Instruments Co., Ltd.), the resin is made into combustion gas, and the gas is absorbed into an absorbing liquid. Then, by ion chromatography (apparatus name: Ion Chromatograph ICS 2000, column: IONPAC AS17, manufactured by Japan Dionex Corporation), the amount of the sulfur element in the resin or the toner particles (ppm) is measured. The obtained value is divided by the atomic weight of sulfur (32.06) to calculate the molar number of sulfur atom (μmol/g).

<Methods of Measuring Weight Average Particle Diameter (D4) and Number Average Particle Diameter (D1) of Toner>

The weight average particle diameter (D4) and the number average particle diameter (D1) of the toner are calculated as follows. As a measurement apparatus, a precise particle size distribution measurement apparatus "Coulter Counter Multisizer 3" (registered trademark, manufactured by Beckman Coulter, Inc.) equipped with a 100 μm aperture tube by the pore electric resistance method is used. Regarding setting of the measurement condition and analysis of the measurement data, an attached dedicated software "Beckman Coulter Multisizer 3 Version 3.51" (manufactured by Beckman Coulter, Inc.) is used.

Herein, the measurement is performed with the number of effective measurement channels of 25,000 channels.

As the electrolytic aqueous solution to be used for the measurement, a solution prepared by dissolving special grade sodium chloride in ion-exchange water in such a way as to have a concentration of about 1% by mass, for example, "ISOTON II" (produced by Beckman Coulter, Inc.), can be used.

Herein, prior to the measurement and the analysis, the dedicated software is set as described below. In the screen of "Modification of the standard operating method (SOM)" of the dedicated software, the total count number in the control mode is set at 50,000 particles, the number of measurements is set at 1 time, and the Kd value is set at a value obtained by using "Standard particles 10.0 μm" (manufactured by Beckman Coulter, Inc.). The threshold value and the noise level are automatically set by pressing "Threshold value/noise level measurement button". The current is set at 1,600 μA, the gain is set at 2, the electrolytic solution is set at ISOTON II, and a check mark is placed in "Post-measurement aperture tube flush". In the screen of "Setting of conversion from pulses to particle diameter" of the dedicated software, the bin interval is set at a logarithmic particle diameter, the particle diameter bin is set at 256 particle diameter bins, and the particle diameter range is set at 2 μm to 60 μm The specific measurement process is as described below.

(1) The electrolytic aqueous solution (200 ml) is charged in a 250 ml round-bottom glass beaker dedicated to Multisizer 3, the beaker is set in a sample stand, and counterclockwise stirring is performed with a stirrer rod at 24 revolutions/sec. Then, contamination and air bubbles in the aperture tube are removed by "Aperture flush" function of the dedicated software.

(2) The electrolytic aqueous solution (30 ml) is charged in a 100 ml flat-bottom glass beaker. A diluted liquid is prepared by diluting "Contaminon N" (a 10% by mass aqueous solution of a neutral detergent for washing a precision measuring device, including a nonionic surfactant, an anionic surfactant and an organic builder, and having a pH of 7, produced by Wako Pure Chemical Industries, Ltd.) with ion-exchange water by a factor of about 3 on a mass basis, and 0.3 ml of the diluted solution is added into the beaker as a dispersing agent.

(3) An ultrasonic dispersing device "Ultrasonic Dispersion System Tetora 150" (manufactured by Nikkaki Bios Co., Ltd.) is prepared, the device incorporating two oscillators having an oscillatory frequency of 50 kHz so that the phases are displaced by 180 degrees and having an electrical output of 120 W. Then, 3.3 l of ion-exchange water is charged into the water tank of the ultrasonic dispersion device, and 2 ml of Contaminon N is added into the water tank.

(4) The beaker in the (2) is set in the beaker fixing hole of the above ultrasonic dispersion system, and the ultrasonic dispersion device is actuated. The height position of the beaker is adjusted so that the resonance state of the liquid surface of the electrolytic aqueous solution in the beaker is maximized.

(5) While the electrolytic aqueous solution in the beaker of the (4) is irradiated with an ultrasonic wave, 10 mg of the toner is added to the electrolytic aqueous solution little by little and is dispersed.

Subsequently, such an ultrasonic dispersion treatment is further continued for 60 seconds. Herein, in the ultrasonic dispersion, the water temperature of the water tank is appropriately controlled so as to be not lower than 10° C. and not higher than 40° C.

(6) The electrolytic aqueous solution, in which the toner is dispersed, of the item (5) is dropped to the round-bottom beaker of the (1) set in the sample stand by using a pipette and prepared so that the measurement concentration is 5%. Then, the measurement is performed until the number of the measured particles reaches 50,000.

(7) The measurement data is analyzed by the dedicated software attached to the apparatus, and the weight average particle diameter (D4) and the number average particle diameter (D1) are calculated. Herein, when Graph/% by volume is set in the dedicated software, "Average diameter" on the screen of "Analysis/statistical value on volume (arithmetic average)" is the weight average particle diameter (D4), and when Graph/% by number is set in the dedicated software, "Average diameter" on the screen of "Analysis/statistical value on number (arithmetic average)" is the number average particle diameter (D1).

EXAMPLES

Hereinafter, the present invention will be described in detail with reference to examples, but not be limited to these examples. It is to be noted that "part(s)" means "part(s) by mass".

Synthesis Example of Vinyl Monomer 1a

Step 1

One hundred g of 2,5-dihydroxy benzoic acid and 1,441 g of 80% sulfuric acid were heated to 50° C. and mixed. Tert-butylalcohol (144 g) was added to the dispersion liquid and stirred at 50° C. for 30 minutes. Thereafter, the operation, where 144 g of tert-butylalcohol was added to the dispersion liquid and stirred for 30 minutes, was performed 3 times. The reaction liquid was cooled to room temperature, and slowly added to 1 kg of ice water. The resultant precipitate was collected by filtration, and washed with water and then hexane. The precipitate was dissolved in 200 mL of methanol and reprecipitated in 3.6 L of water. After being collected by filtration, the resultant was dried at 80° C. to thereby obtain 74.9 g of a salicylic acid intermediate represented by the following formula (7).

Formula (7)

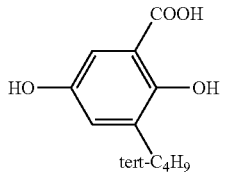

Step 2

The obtained salicylic acid intermediate (25.0 g) was dissolved in 150 mL of methanol, and 36.9 g of potassium carbonate was added thereto and heated to 65° C. A mixed liquid of 18.7 g of 4-(chloromethyl)styrene and 100 mL of methanol was dropped to the reaction liquid and allowed to react at 65° C. for 3 hours. The reaction liquid was cooled and then filtrated, and the filtrate was concentrated to obtain a crude product. The crude product was dispersed in 1.5 L of water at a pH of 2, and extracted by adding ethyl acetate. Thereafter, the resultant was washed with water and dried over magnesium sulfate, and ethyl acetate was distilled off under reduced pressure to obtain a precipitate. After being washed with hexane, the precipitate was recrystallized by toluene and ethyl acetate to be purified to obtain 20.1 g of a vinyl monomer 1a represented by the following formula (8).

Formula (8)

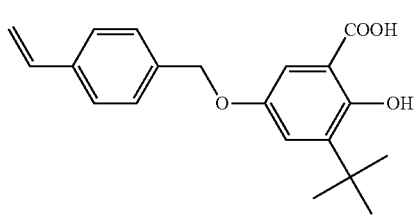

Synthesis Example of Vinyl Monomer 1b

One hundred g of 2,5-dihydroxy benzoic acid was dissolved in 2 L of methanol, and 88.3 g of potassium carbonate was added thereto and heated to 67° C. 4-(chloromethyl) styrene (102.0 g) was dropped to the reaction liquid over 22 minutes, and stirred at 67° C. for 12 hours. After the reaction liquid was cooled, methanol was distilled off under reduced pressure, and the resultant was washed with hexane. The residue was dissolved in methanol and dropped in water, and reprecipitated to collect a precipitate by filtration. Such a recrystallizing operation was repeated twice, and the residue was dried at 80° C. to obtain a vinyl monomer 1b represented by the following formula (9).

Formula (9)

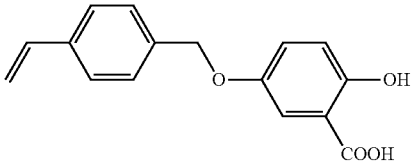

Synthesis Example of Vinyl Monomer 1c

A vinyl monomer 1c represented by the following formula (10) was obtained by the same method as in the synthesis of the vinyl monomer 1a (step 2) except that the salicylic acid intermediate of the formula (7) was changed to 18 g of 2,6-dihydroxy benzoic acid.

Formula (10)

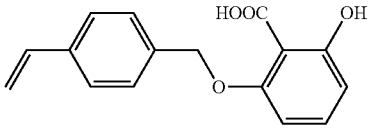

Synthesis of Vinyl Monomer 1d

A salicylic acid intermediate was obtained by the same method as in the synthesis of the vinyl monomer 1a (step 1) except that 144 g of tert-butylalcohol was changed to 253 g of 2-octanol. A vinyl monomer 1d represented by the following formula (11) was obtained by the same method as in the synthesis of the vinyl monomer 1a (step 2) except that 32 g of the salicylic acid intermediate obtained herein was used.

Formula (11)

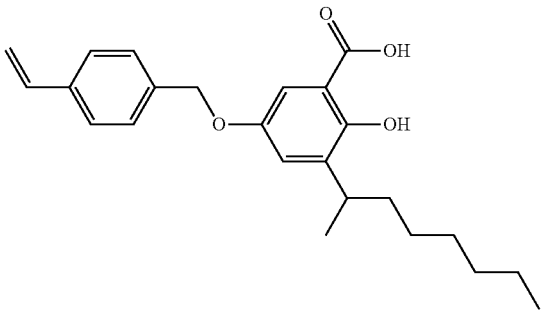

Synthesis of Vinyl Monomer 1e

A vinyl monomer 1e represented by the following formula (12) was obtained by the same method as in the synthesis of the vinyl monomer 1a (step 2) except that the salicylic acid intermediate of the formula (7) was changed to 22 g of 2,5-dihydroxy-3-methoxybenzoic acid.

Formula (12)

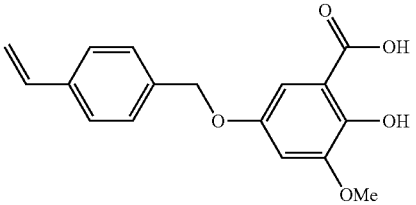

Synthesis of Vinyl Monomer 1f

A vinyl monomer 1f represented by the following formula (13) was obtained by the same method as in the synthesis of the vinyl monomer 1a (step 2) except that the salicylic acid intermediate of the formula (7) was changed to 18 g of 2,4-dihydroxy benzoic acid.

Formula (13)

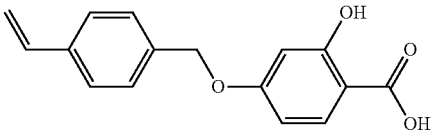

Synthesis of Vinyl Monomer 1h

A vinyl monomer 1h represented by the following formula (14) was obtained by the same method as in the synthesis of the vinyl monomer 1a (step 2) except that the salicylic acid intermediate of the formula (7) was changed to 18 g of 2,3-dihydroxy benzoic acid.

Formula (14)

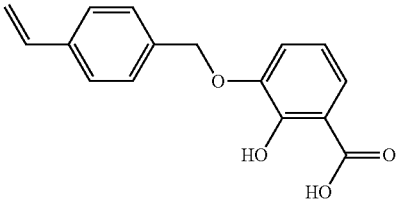

Synthesis Example of Vinyl Monomer 1i

A vinyl monomer 1i represented by the following formula (15) was obtained by the same method as in the vinyl monomer 1a except that the 4-(chloromethyl)styrene was changed to chloromethylstyrene (produced by AGC SEIMI CHEMICAL CO., LTD., trade name "CMS-P").

Formula (15) (Mixture)

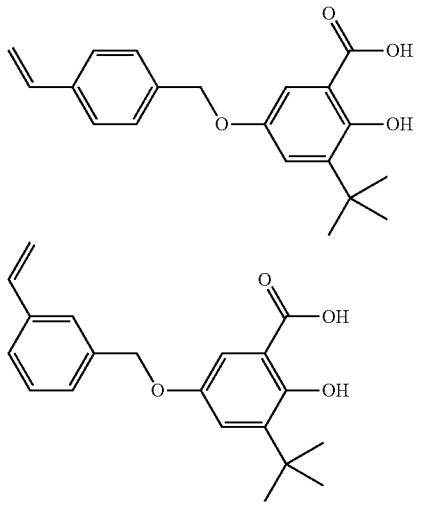

Synthesis Example of Polymer A-1

The vinyl monomer 1a represented by the formula (8) (9.91 g) and 60.1 g of styrene were dissolved in 42.0 ml of toluene, stirred for 1 hour, and then heated to 110° C. A mixed liquid of 4.62 g of tert-butylperoxyisopropyl monocarbonate (produced by NOF CORPORATION, trade name: Perbutyl I) and 42 ml of toluene was dropped to the reaction liquid. The resultant was further allowed to react at 110° C. for 4 hours, and thereafter cooled and dropped to 1 L of methanol to obtain a precipitate. After the obtained precipitate was dissolved in 120 ml of THF, the resultant was dropped to 1.80 L of methanol to precipitate a white precipitate. The precipitate was collected by filtration and dried under reduced pressure at 90° C. to thereby obtain 57.6 g of a polymer A-1. The hydroxyl value of the obtained polymer A-1 was measured to confirm the content of the component derived from the vinyl monomer 1a.

Synthesis Example of Polymer A-2

A polymer was synthesized by the same method as in the Synthesis Example of the polymer A-1 except that the amount of toluene was changed to 100 ml and the amount of tert-butylperoxyisopropyl monocarbonate was changed to 7.40 g. The obtained polymer was taken by GPC in 10 fractions, the second and third fractions from the low-molecular weight side were recovered, and concentrated and dried to obtain a polymer A-2. The hydroxyl value of the polymer A-2 was measured to confirm the content of the component derived from the vinyl monomer 1a.

Synthesis Example of Polymer A-3

A polymer A-3 was synthesized by the same method as in the Synthesis Example of the polymer A-1 except that the amount of toluene was changed to 30.0 ml and the amount of tert-butylperoxyisopropyl monocarbonate was changed to 2.30 g. The hydroxyl value of the polymer A-3 was measured to confirm the content of the component derived from the vinyl monomer 1a.

Synthesis Example of Polymer A-4

A polymer A-4 was synthesized by the same method as in the case of the polymer A-1 except that the amount of the vinyl monomer 1a was changed to 42.4 g and the amount of styrene was changed to 31.6 g. The hydroxyl value was measured to confirm the content of the component derived from the vinyl monomer 1a.

Synthesis Example of Polymer A-5

A polymer A-5 was synthesized by the same method as in the case of the polymer A-1 except that the amount of the vinyl monomer 1a was changed to 0.230 g and the amount of styrene was changed to 73.8 g. The hydroxyl value was measured to confirm the content of the component derived from the vinyl monomer 1a.

Synthesis Example of Polymer A-6

A polymer A-6 was synthesized by the same method as in the case of the polymer A-1 except that the amount of the vinyl monomer 1a was changed to 0.350 g and the amount of styrene was changed to 73.7 g. The hydroxyl value was measured to confirm the content of the component derived from the vinyl monomer 1a.

Synthesis Example of Polymer A-7

A polymer A-7 was synthesized by the same method as in the case of the polymer A-1 except that the amount of the vinyl monomer 1a was changed to 35.5 g and the amount of styrene was changed to 38.5 g. The hydroxyl value was measured to confirm the content of the component derived from the vinyl monomer 1a.

Synthesis Example of Polymer A-8

A polymer A-8 was synthesized by the same method as in the case of the polymer A-1 except that the vinyl monomer 1a was changed to the vinyl monomer 1b (8.90 g) and the amount of styrene was changed to 65.1 g. The hydroxyl value was measured to confirm the content of the component derived from the vinyl monomer 1b.

Synthesis Example of Polymer A-9

A polymer A-9 was synthesized by the same method as in the case of the polymer A-1 except that the vinyl monomer 1a was changed to the vinyl monomer 1c (8.90 g) and the amount of styrene was changed to 65.1 g. The hydroxyl value was measured to confirm the content of the component derived from the vinyl monomer 1c.

Synthesis Example of Polymer A-10

A polymer A-10 was synthesized by the same method as in the Synthesis Example of the polymer A-1 except that the composition of the reaction liquid was changed as follows: the amount of the vinyl monomer 1a to 8.70 g, the amount of styrene to 57.0 g, and the amount of butyl acrylate to 8.30 g. The hydroxyl value was measured to confirm the content of the component derived from the vinyl monomer 1a.

Synthesis Example of Polymer A-11

A compound represented by the following formula (16) was obtained by the same method as in the synthesis of the vinyl monomer 1a (step 2) except that the salicylic acid derivative of the formula (7) was changed to 2,5-dihydroxy benzoic acid and 4-(chloromethyl)styrene was changed to p-aminobenzylchloride.

Then, the following materials:

| | |
|---|---|
| Bisphenol A • propylene oxide 2.2 mol adduct | 67.8 parts |
| Terephthalic acid | 22.2 parts |
| Trimellitic anhydride | 10.0 parts |
| Dibutyltin oxide | 0.00500 parts |

were charged in a four-necked flask, to which a thermometer, a stirring rod, a capacitor and a nitrogen-introducing tube were equipped. The materials were allowed to react under a nitrogen atmosphere at 220° C. for 5 hours to obtain a polyester resin P-1.

The obtained polyester resin P-1 (85.0 parts) and 15.0 parts of a compound represented by the following formula (16) were charged into a reaction container, in which a condenser tube, a stirrer and a thermometer were immersed. After 270 parts of pyridine was added thereto and stirred, 96.0 parts of triphenyl phosphite was added thereto and stirred at 120° C. for 6 hours. After the completion of the reaction, the resultant was recrystallized in 360 parts of ethanol to recover a polymer. After the obtained polymer was washed twice with 140 parts of 1N hydrochloric acid, the polymer was dried under reduced pressure to obtain a polymer A-11. The hydroxyl value was measured to confirm the content of the component derived from the formula (16).

Formula (16)

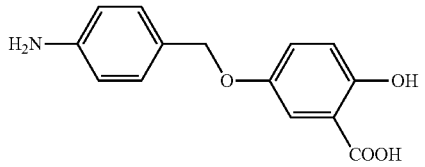

Synthesis Example of Polymer A-12

A polymer A-12 was synthesized by the same method as in the Synthesis Example of the polymer A-1 except that 66.6 f of butyl acrylate was used in place of the styrene and the amount of the vinyl monomer 1a was changed to 7.40 g. The hydroxyl value was measured to confirm the content of the component derived from the vinyl monomer 1a.

Synthesis Example of Polymer A-13

A polymer A-13 was synthesized by the same method as in the Synthesis Example of the polymer A-1 except that the vinyl monomer 1a was changed to a compound represented by the following formula (17) (7.4 g) and the amount of styrene was changed to 66.6 g. The hydroxyl value of the polymer A-13 was measured to confirm the content of the component derived from the formula (17).

Formula (17)

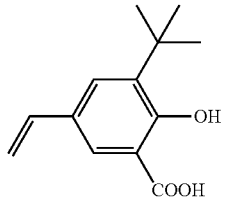

Synthesis Example of Polymer A-14

A polymer A-14 was synthesized by the same method as in the Synthesis Example of the polymer A-1 except that the vinyl monomer 1a was changed to the vinyl monomer 1d (12.0 g) and the amount of styrene was changed to 62.0 g. The hydroxyl value was measured to confirm the content of the component derived from the vinyl monomer 1d Synthesis Example of Polymer A-15

A polymer A-15 was synthesized by the same method as in the Synthesis Example of the polymer A-1 except that the vinyl monomer 1a was changed to the vinyl monomer 1e (9.75 g) and the amount of styrene was changed to 64.2 g. The hydroxyl value was measured to confirm the content of the component derived from the vinyl monomer 1e.

Synthesis Example of Polymer A-16

A polymer A-16 was synthesized by the same method as in the Synthesis Example of the polymer A-1 except that the vinyl monomer 1a was changed to the vinyl monomer 1f (8.89 g) and the amount of styrene was changed to 65.1 g. The hydroxyl value was measured to confirm the content of the component derived from the vinyl monomer 1f.

Synthesis Example of Polymer A-17

A polymer A-17 was synthesized by the same method as in the Synthesis Example of the polymer A-1 except that the vinyl monomer 1a was changed to the vinyl monomer 1h (8.89 g) and the amount of styrene was changed to 65.1 g. The hydroxyl value was measured to confirm the content of the component derived from the vinyl monomer 1h Synthesis Example of Polymer A-18

A polymer A-18 was synthesized by the same method as in the Synthesis Example of the polymer A-1 except that the vinyl monomer 1a was changed to the vinyl monomer 1i. The hydroxyl value was measured to confirm the content of the component derived from the vinyl monomer 1i.

Synthesis Example of Polymer B-1

Two hundred parts of xylene was charged into a reaction container equipped with a stirrer, a capacitor, a thermometer and a nitrogen-introducing tube, and refluxed under a nitrogen stream.

| | |
|---|---|
| 2-acrylamide-2-methylpropane sulfonic acid | 6.00 parts |
| Styrene | 78.0 parts |
| 2-ethylhexyl acrylate | 16.0 parts |
| Dimethyl-2,2'-azobis(2-methylpropionate) | 5.00 parts |

The above materials were mixed, dropped to the reaction container with being stirred, and kept for 10 hours. Thereafter, the solvent was distilled off by evaporation, and the resultant was dried under reduced pressure at 40° C. to obtain a polymer B-1. The amount of sulfur atoms in the obtained polymer B-1 was quantified by elemental analysis to confirm the content of the unit derived from sulfonic acid.

Synthesis Example of Polymer B-2

A polymer B-2 was synthesized by the same synthesis as in the case of polymer B-1 except that the following materials were used.

| | |
|---|---|
| Methyl 2-acrylamide-5-methoxybenzenesulfonate | 16.0 parts |
| Styrene | 74.0 parts |

-continued

| | |
|---|---|
| n-butyl acrylate | 10.0 parts |
| Dimethyl-2,2'-azobis(2-methylpropionate) | 5.00 parts |

The amount of sulfur atoms in the obtained polymer B-2 was quantified by elemental analysis to confirm the content of the unit derived from sulfonic acid.

Synthesis Example of Polymer B-3

A polymer B-3 was synthesized by the same synthesis as in the case of polymer B-1 except that the following materials were used.

| | |
|---|---|
| Methyl 2-acrylamide-2-methylpropanesulfonate | 12.0 parts |
| Styrene | 72.0 parts |
| 2-ethylhexyl acrylate | 16.0 parts |
| Dimethyl-2,2'-azobis(2-methylpropionate) | 5.00 parts |

The amount of sulfur atoms in the obtained polymer B-3 was quantified by elemental analysis to confirm the content of the unit derived from sulfonic acid.

Synthesis Example of Polymer B-4

A polymer B-4 was synthesized by the same synthesis as in the case of polymer B-1 except that the following materials were used.

| | |
|---|---|
| 2-acrylamide-5-methoxybenzenesulfonic acid | 8.00 parts |
| Styrene | 76.0 parts |
| 2-ethylhexyl acrylate | 16.0 parts |
| Dimethyl-2,2'-azobis(2-methylpropionate) | 5.00 parts |

The amount of sulfur atoms in the obtained polymer B-4 was quantified by elemental analysis to confirm the content of the unit derived from sulfonic acid.

Synthesis Example of Polymer B-5

A polymer B-5 was synthesized by the same synthesis as in the case of polymer B-1 except that the following materials were used.

| | |
|---|---|
| 2-acrylamide-2-methylpropane sulfonic acid | 6.0 parts |
| Styrene | 78.0 parts |
| 2-ethylhexyl acrylate | 16.0 parts |
| Dimethyl-2,2'-azobis(2-methylpropionate) | 5.00 parts |

The amount of sulfur atoms in the obtained polymer B-5 was quantified by elemental analysis to confirm the content of the unit derived from sulfonic acid.

Synthesis Example of Polymer B-6

Production of Polyester Resin P-2

| | |
|---|---|
| Bisphenol A • propylene oxide 2.2 mol adduct | 69.0 parts |
| Terephthalic acid | 28.0 parts |
| Fumaric acid | 3.00 parts |
| Dibutyltin oxide | 0.00500 parts |

The above materials were charged in a four-necked flask, to which a thermometer, a stirring rod, a capacitor and a nitrogen-introducing tube were equipped. The materials were allowed to react under a nitrogen atmosphere at 220° C. for 5 hours to obtain a polyester resin P-2.

Two hundred parts of xylene was charged into a reaction container equipped with a stirrer, a capacitor, a thermometer and a nitrogen-introducing tube, and refluxed under a nitrogen stream. Seventy parts of the resin P-2 was charged thereinto and dissolved.

| | |
|---|---|
| Methyl 2-acrylamide-5-methoxybenzenesulfonate | 15.0 parts |
| Styrene | 15.0 parts |
| Dimethyl-2,2'-azobis(2-methylpropionate) | 1.50 parts |

Then, the above materials were mixed, dropped to the reaction container with being stirred, and kept for 10 hours. Thereafter, the solvent was distilled off by evaporation, and the resultant was dried under reduced pressure at 40° C. to obtain a polymer B-6.

The amount of sulfur atoms in the obtained polymer B-6 was quantified by elemental analysis to confirm the content of the unit derived from sulfonic acid.

The physical properties of the produced polymers as described above were shown in Table 2.

TABLE 2

| | Polymer having structure "a" | | | | | Polymer having structure "b" | | |
|---|---|---|---|---|---|---|---|---|
| | Main backbone | Polymerizable monomer according to structure "a" | Hydroxyl value derived from structure "a" (mgKOH/g) | Content x of structure "a" (mmol/g) | Weight average molecular weight Mw | S amount in polymer (% by mass) | Content y of structure "b" (mmol/g) | Weight average molecular weight Mw |
| Polymer A-1 | Vinyl-based resin | 1a | 23.28 | 415.0 | 65900 | — | — | — |
| Polymer A-2 | Vinyl-based resin | 1a | 22.38 | 398.9 | 1100 | — | — | — |
| Polymer A-3 | Vinyl-based resin | 1a | 22.61 | 403.0 | 97300 | — | — | — |
| Polymer A-4 | Vinyl-based resin | 1a | 96.49 | 1720.0 | 54200 | — | — | — |
| Polymer A-5 | Vinyl-based resin | 1a | 0.49 | 8.7 | 15700 | — | — | — |
| Polymer A-6 | Vinyl-based resin | 1a | 0.72 | 13.0 | 17800 | — | — | — |
| Polymer A-7 | Vinyl-based resin | 1a | 79.10 | 1410.0 | 66900 | — | — | — |
| Polymer A-8 | Vinyl-based resin | 1b | 23.11 | 411.9 | 36800 | — | — | — |
| Polymer A-9 | Vinyl-based resin | 1c | 40.78 | 726.9 | 52700 | — | — | — |
| Polymer A-10 | Vinyl-based resin | 1a | 22.66 | 403.9 | 9700 | — | — | — |
| Polymer A-11 | Polyester-based resin | Formula (16) | 27.21 | 485.0 | 11000 | — | — | — |
| Polymer A-12 | Vinyl-based resin | 1a | 19.30 | 344.0 | 23500 | — | — | — |
| Polymer A-13 | Vinyl-based resin | Formula (17) | 23.11 | 411.9 | 17300 | — | — | — |

TABLE 2-continued

| | Polymer having structure "a" | | | | | Polymer having structure "b" | | |
|---|---|---|---|---|---|---|---|---|
| | Main backbone | Polymerizable monomer according to structure "a" | Hydroxyl value derived from structure "a" (mgKOH/g) | Content x of structure "a" (mmol/g) | Weight average molecular weight Mw | S amount in polymer (% by mass) | Content y of structure "b" (mmol/g) | Weight average molecular weight Mw |
| Polymer A-14 | Vinyl-based resin | 1d | 22.57 | 402.3 | 68200 | — | — | — |
| Polymer A-15 | Vinyl-based resin | 1e | 23.63 | 421.2 | 74100 | — | — | — |
| Polymer A-16 | Vinyl-based resin | 1f | 24.19 | 431.2 | 52300 | — | — | — |
| Polymer A-17 | Vinyl-based resin | 1h | 24.44 | 435.7 | 69600 | — | — | — |
| Polymer A-18 | Vinyl-based resin | 1i | 23.12 | 412.1 | 58700 | — | — | — |
| Polymer B-1 | — | — | — | — | — | 0.843 | 263 | 18500 |
| Polymer B-2 | — | — | — | — | — | 1.73 | 539 | 12300 |
| Polymer B-3 | — | — | — | — | — | 1.67 | 521 | 14900 |
| Polymer B-4 | — | — | — | — | — | 0.930 | 290 | 19000 |
| Polymer B-5 | — | — | — | — | — | 0.843 | 263 | 18500 |
| Polymer B-6 | — | — | — | — | — | 1.61 | 502 | 9700 |

Example 1

Production of Pigment-Dispersed Paste

| | |
|---|---|
| Styrene | 58.5 parts |
| C.I. Pigment Blue 15:3(Cu phthalocyanine pigment) | 9.75 parts |
| Polymer A-1 | 1.13 parts |

The above materials were well premixed, and then dispersed by a bead mill for 10 hours, with being kept at not higher than 20° C., to produce a pigment-dispersed paste.

Production of Toner Particles:

An aqueous 0.1 mol/l-$Na_3PO_4$ solution (350 parts) was charged to 1,200 parts of ion-exchange water, warmed to 60° C., and then stirred at 11,000 rpm by using CLEARMIX (manufactured by M Technique Co., Ltd.). An aqueous 1.00 mol/l-$CaCl_2$ solution (52.0 parts) was added thereto to obtain a dispersing medium containing $Ca_3(PO_4)_2$.

| | |
|---|---|
| Above pigment-dispersed paste | 46.1 parts |
| Styrene | 31.0 parts |
| n-butyl acrylate | 30.0 parts |
| Ester wax | 10.0 parts |

(main component: $C_{19}H_{39}COOC_{20}H_{41}$, maximum endothermic peak temperature: 68.6° C.)

| | |
|---|---|
| Saturated polyester resin | 5.00 parts |

(terephthalic acid-propylene oxide modified bisphenol A copolymer, acid value: 10.0 mgKOH/g, Mw: 16,000)

The above materials were warmed to 60° C., and stirred for 1 hour with being kept at 60° C. so as to be sufficiently dissolved and dispersed to give a monomer mixture. With further keeping at 60° C., 10.0 parts of 2,2'-azobis(2,4-dimethylvaleronitrile) as a polymerization initiator was added and dissolved to prepare a monomer composition.

The monomer composition was charged into the dispersing medium. The resultant was stirred at 60° C. in a nitrogen atmosphere with CLEARMIX at 10,000 rpm for 30 minutes to granulate the monomer composition. Thereafter, the granulated product was allowed to react at 75° C. for 5 hours with being stirred with a paddle stirring blade, and the polymerization of the polymerizable monomer was completed. The resultant was cooled to room temperature, and thereafter hydrochloric acid was added thereto to dissolve $Ca_3(PO_4)_2$ on the surfaces of the particles, followed by filtration, washing with water and drying to obtain toner particles 1. The particle size distribution of the obtained toner particles was evaluated by calculating the D4/D1.

Production of Toner:

One part of a hydrophobic silica fine powder was mixed with and externally added to 100 parts of the obtained toner particles 1 by Henschel Mixer (Mitsui Miike Chemical Engineering Machinery Co., Ltd.) to obtain a toner 1. The hydrophobic silica fine powder was a powder whose surface was treated with hexamethyldisilazane and then silicone oil, which had a number average primary particle diameter of 9 nm and a BET specific surface area of 180 $m^2/g$.

The physical properties of the obtained toner were shown in Table 3.

<Measurement of Degree of Aggregation>

The degree of aggregation of the toner 1 and a toner obtained by leaving the toner 1 under extreme conditions (toner left under extreme conditions) were measured.

As the measurement apparatus, a digital display vibration meter "DIGIVIBLO MODEL 1332A" (manufactured by Showa Sokki Corporation) was connected to a side surface portion of a vibrating table of a "Powder Tester" (manufactured by Hosokawa Micron Corporation) was used. Then, a sieve having an aperture of 20 μm (635 meshes), a sieve having an aperture of 38 μm (390 meshes), and a sieve having an aperture of 75 μm (200 meshes) were superimposed and set in this order from below on the vibrating table of the Powder Tester. The measurement was performed in a 23° C. and 60% RH environment as follows.

(1) The amplitude of the vibrating table was previously adjusted so that the displacement value of the digital display vibration meter was 0.60 mm (peak-to-peak).

(2) Five g of the toner was gently placed on the sieve having an aperture of 75 μm at the uppermost stage.

(3) After the sieves were vibrated for 15 seconds, the mass of the toner remaining on each sieve was measured, and the degree of aggregation was calculated based on the following equation.

$$\text{Degree of aggregation (\%)}=\{(\text{mass (g) of sample on sieve having aperture of 75 }\mu\text{m})/5(\text{g})\}\times100+\{(\text{mass (g) of sample on sieve having aperture of 38 }\mu\text{m})/5(\text{g})\}\times100\times0.6+\{(\text{mass (g) of sample on sieve having aperture of 20 }\mu\text{m})/5(\text{g})\}\times100\times0.2$$

<Preparation of Sample for Measuring Degree of Aggregation> i) Degree of Aggregation of Toner 1

The toner 1 obtained in Example 1 (5.00 g) was weighed in a 100-ml plastic cup, charged into a thermostat set to a temperature of 23° C. and a humidity of 60%, and left for 2 days.

ii) Degree of Aggregation of Toner Left Under Extreme Conditions

The toner 1 obtained in Example 1 (5.00 g) was weighed in a 100-ml plastic cup, charged into a thermostat set to a temperature of 40° C. and a humidity of 95%, and left for 10 days.

<Evaluation of Fluidity>

The difference between the degree of aggregation of the toner left under extreme conditions and the degree of aggregation of the toner 1 was determined and evaluated.

The difference was ranked based on the following.

A Rank: difference in degree of aggregation was not less than 0 and less than 5%

B Rank: difference in degree of aggregation was not less than 5 and less than 10%

C Rank: difference in degree of aggregation was not less than 10 and less than 15%

D Rank: difference in degree of aggregation was not less than 15 and less than 20%

E Rank: difference in degree of aggregation was not less than 20%

<Evaluation of Saturated Charge Amount of Toner>

The two-component developer was produced as follows.

(Production of Carrier)

A magnetite powder having a number average particle diameter of 0.25 μm and a hematite powder having a number average particle diameter of 0.60 μm were lipophilized as follows: specifically, each of the powders was mixed with 4.0% by mass of a silane-based coupling agent (3-(2-aminoethylaminopropyl)trimethoxysilane), and stirred in a container at not lower than 100° C. at a high speed.

| | |
|---|---|
| Phenol | 10.0 parts |
| Formaldehyde solution (formaldehyde 40%, methanol 10%, water 50%) | 6.0 parts |
| lipophilized magnetite | 63.0 parts |
| Lipophilized hematite | 21.0 parts |

The above materials, 5 parts of a 28% ammonia water and 10 parts of water were charged into a flask, the temperature of the resultant was raised to and kept at 85° C. over 30 minutes with stirring and mixing, and the mixture was allowed to react 3 hours to be cured. Thereafter, the resultant was cooled to 30° C. and water was further added thereto. The supernatant was removed, and the obtained precipitate was washed with water and dried in air. Then, the resultant was dried under reduced pressure (not more than 5 mmHg) at 60° C. to obtain spherical magnetic resin particles in which the magnetic material was dispersed.

As a coating resin, a copolymer of methylmethacrylate and a methylmethacrylate having a perfluoroalkyl group (m=7) (copolymerization ratio of 8:1, weight average molecular weight: 45,000) was used. Ten parts of melamine particles having a particle diameter of 290 nm and 6 parts of carbon particles having a specific resistance of $1\times10^{-2}$ Ω·cm and a particle diameter of 30 nm were added to 100 parts of the coating resin, and dispersed by an ultrasonic disperser for 30 minutes. Further, a coating solution was produced in a mixed solvent of methyl ethyl ketone and toluene so that the coating resin content relative to the carrier core was 2.5 parts (solution concentration 10% by mass).

The solvent in the coating solution was volatilized at 70° C. while continuously applying a shear force, thereby coating the surfaces of the magnetic resin particles with the resin. The magnetic carrier particles coated with the resin were heat-treated at 100° C. for 2 hours with being stirred, and cooled and ground. Thereafter, the particles were classified by the sieve having 200 meshes to obtain a carrier having a number average particle diameter of 33 μm, a true specific gravity of 3.53 g/cm$^3$, an apparent specific gravity of 1.84 g/cm$^3$, and a magnetization intensity of 42 Am$^2$/kg.

The toner 1 and the obtained carrier were mixed so that the concentration of the toner was 7.0% by mass, thereby obtaining a two-component developer. The obtained two-component developer was weighed in an amount of 50.0 g, and left in a 23° C. and 60% Rh environment for 2 days. Thereafter, the resultant was charged into a 50 ml plastic container and shaked by a shaker (YS-LD, manufactured by Yayoi Co., Ltd.) at a speed of 4 reciprocations per second for 2 minutes, and the charge amount was measured by using the apparatus in FIG. 1. The charge amount was considered as the saturated charge amount.

<Evaluation of Toner Charge Amount Rise Property>

The two-component developer left in a 23° C. and 60% RH environment for 2 days was weighed in an amount of 50.0 g and charged into a 50 ml plastic container. The content was shaked by hand 180 times at a speed of 2 reciprocations per second, and the charge amount was measured by using the apparatus in FIG. 1. The rise to the saturated charge amount at the time of shaking 180 times (%) was calculated by the following equation.

$$\text{Rise (\%)}=\{\text{Charge amount at the time of shaking 180 times (mC/kg)}/\text{Saturated charge amount (mC/kg)}\}\times100$$

<Evaluation of Toner Charge Amount Distribution>

Using a charge amount distribution measurement apparatus (manufactured by Hosokawa Micron Corporation; Model Espert Analyzer EST-3), the spread of the charge amount distribution was evaluated based on the obtained q/d distribution. The two-component developer (270 g) was taken, and left for 2 days under an ordinary-temperature and ordinary-humidity environment (23° C./60% RH). The two-component developer was charged into a developing unit of a color laser copier, CLC 5000, (manufactured by Canon Inc.). The charge amount distribution of the two-component developer was measured after being rotated for 5 minutes (initial) by an idling apparatus equipped with an external motor. The two measured values were compared. The evaluation criteria were as follows.

Figure 2A:
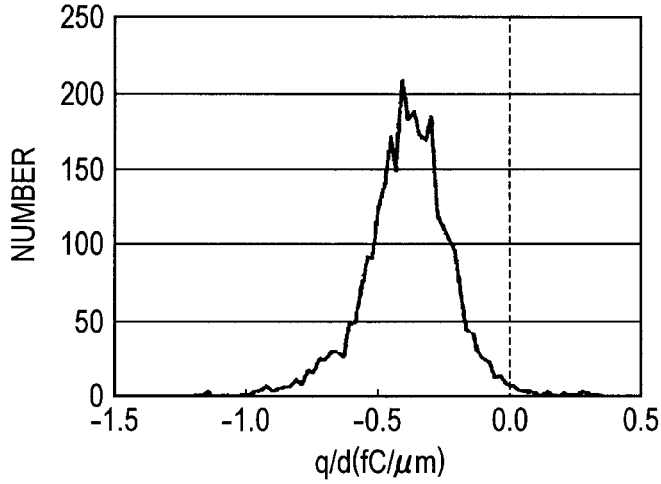
FIGS. 2A, 2B, and 2C are used as evaluation criteria of a charge amount distribution in the present invention.

A Rank: as illustrated in FIG. 2A, there were few toners charged on (+) side, and distribution width was narrow.

Figure 2B:
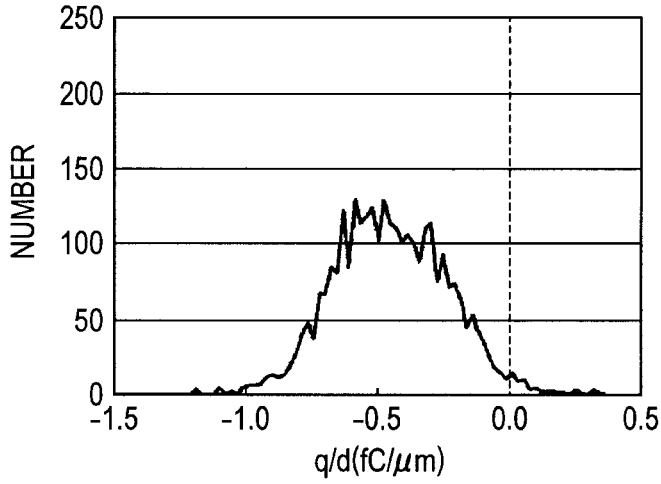

B Rank: As illustrated in FIG. 2B, distribution width was broad.

Figure 2C:
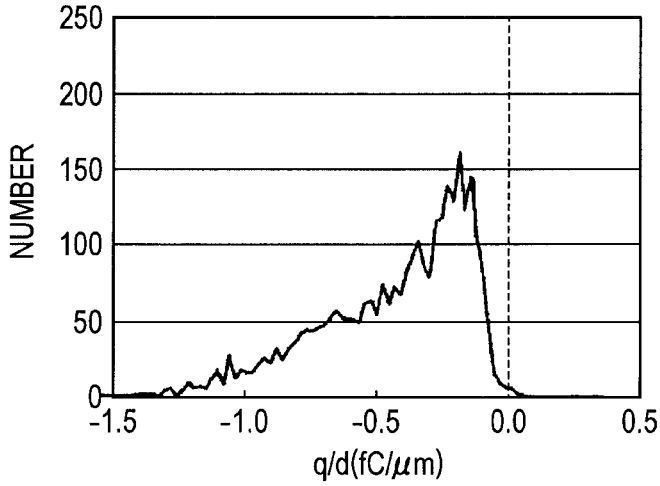

C Rank: As illustrated in FIG. 2C, distribution width was broad and toner amount charged on (+) side increased.

The obtained evaluation results were shown in Table 4.

Example 2

A toner 2 was obtained in the same manner as in Example 1 except that the materials used for producing the pigment-dispersed paste in Example 1 were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-2 | 1.13 parts |

Example 3

A toner 3 was obtained in the same manner as in Example 1 except that the materials used for producing the pigment-dispersed paste in Example 1 were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-3 | 1.13 parts |

Example 4

A toner 4 was obtained in the same manner as in Example 1 except that the materials used for producing the pigment-dispersed paste in Example 1 were changed as follows and the amount of the pigment-dispersed paste to be used for producing a monomer mixture was changed to 45.6 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 0.0375 parts |

Example 5

A toner 5 was obtained in the same manner as in Example 1 except that the materials used for producing the pigment-dispersed paste in Example 1 were changed as follows and the amount of the pigment-dispersed paste to be used for producing a monomer mixture was changed to 45.6 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 0.113 parts |

Example 6

A toner 6 was obtained in the same manner as in Example 1 except that the materials used for producing the pigment-dispersed paste in Example 1 were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-4 | 1.13 parts |

Example 7

A toner 7 was obtained in the same manner as in Example 1 except that the materials used for producing the pigment-dispersed paste in Example 1 were changed as follows and the amount of the pigment-dispersed paste to be used for producing a monomer mixture was changed to 45.15 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-5 | 1.88 parts |

Example 8

A toner 8 was obtained in the same manner as in Example 1 except that the materials used for producing the pigment-dispersed paste in Example 1 were changed as follows and the amount of the pigment-dispersed paste to be used for producing a monomer mixture was changed to 43.7 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-5 | 9.00 parts |

Example 9

A toner 9 was obtained in the same manner as in Example 1 except that the materials used for producing the pigment-dispersed paste in Example 1 were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-6 | 2.25 parts |

Example 10

A toner 10 was obtained in the same manner as in Example 1 except that the materials used for producing the pigment-dispersed paste in Example 1 were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-7 | 1.13 parts |

Example 11

Production of Polyester Resin P-3

| | |
|---|---|
| Bisphenol A • propylene oxide 2.2 mol adduct | 1200 parts |
| Bisphenol A • ethylene oxide 2.2 mol adduct | 475 parts |
| Terephthalic acid | 249 parts |
| Trimellitic anhydride | 192 parts |
| Fumaric acid | 290 parts |
| Dibutyltin oxide | 0.100 parts |

The above materials were charged into a 4-L four-necked glass flask, to which a thermometer, a stirring rod, a capacitor and a nitrogen-introducing tube were equipped, and the flask was placed into a mantle heater. The materials were allowed to react under a nitrogen atmosphere at 220° C. for 5 hours to obtain a polyester resin P-3.

| | |
|---|---|
| Polyester resin P-3 | 100 parts |
| Polymer A-1 | 0.600 parts |
| C.I. Pigment Blue 15:3 | 5.00 parts |
| Paraffin wax (HNP-7: manufactured by NIPPON SEIRO CO., LTD.) | 3.00 parts |

Then, the above toner materials were sufficiently premixed by Henschel Mixer (Mitsui Miike Chemical Engineering Machinery Co., Ltd., and thereafter the mixture was melt-kneaded by a twin-screw extruder and cooled, and roughly pulverized by using a hammer mill to a particle diameter of about 1 to 2 mm. Then, the coarsely pulverized product was finely pulverized by a fine pulverizer using an air jet technique. Further, the obtained finely pulverized product was classified by a multi classifier to obtain toner particles.

One part of the hydrophobic silica fine powder having a BET of 200 $m^2/g$ based on 100 parts of the above toner particles was externally added by Henschel Mixer to obtain a toner 11. The physical properties of the obtained toner were shown in Table 3. The obtained toner was evaluated in the same manner as in Example 1, and the results were shown in Table 4.

Example 12

A toner 12 was obtained in the same manner as in Example 11 except that the polymer A-1 in Example 11 was changed to the polymer A-7 (20.0 parts). The physical properties of the obtained toner were shown in Table 3. The obtained toner was evaluated in the same manner as in Example 1, and the results were shown in Table 4.

Example 13

A toner 13 was obtained in the same manner as in Example 11 except that the polymer A-1 in Example 11 was changed to the polymer A-7 (17.0 parts). The physical properties of the obtained toner were shown in Table 3. The obtained toner was evaluated in the same manner as in Example 1, and the results were shown in Table 4.

Example 14

Production of Toner Composition Mixed Liquid

| | |
|---|---|
| Copolymerized polyester resin of bisphenol A-propylene oxide adduct/bisphenol A-ethylene oxide adduct/terephthalic acid derivative (Tg: 62° C., softening point: 102° C., Mw: 21000) | 100 parts |
| C.I. Pigment Blue 15:3 | 5.00 parts |
| Paraffin wax (melting point: 72.3° C.) | 8.00 parts |
| Polymer A-1 | 1.20 parts |
| Ethyl acetate | 100 parts |

The above materials were well premixed in a container, and then dispersed by a bead mill for 6 hours with being kept at not higher than 20° C. to produce a toner composition-mixed liquid.

Production of Toner Particles:

An aqueous 0.100 mol/l-$Na_3PO_4$ solution (78.0 parts) was charged to 240 parts of ion-exchange water, warmed to 60° C., and then stirred at 14,000 rpm by using CLEARMIX (manufactured by M Technique Co., Ltd.). An aqueous 1.00 mol/l-$CaCl_2$ solution (12 parts) was added thereto to obtain a dispersing medium containing $Ca_3(PO_4)_2$. Further, 1.00 part of carboxymethylcellulose (trade name: Celogen BS-H, produced by DAI-ICHI KOGYO SEIYAKU CO., LTD.) was added and stirred for 10 minutes.

The dispersing medium prepared in the container of the homomixer was adjusted to a temperature of 30° C. and stirred, and 180 parts of the toner composition-mixed liquid adjusted to a temperature of 30° C. was charged thereinto. The resultant was stirred for 1 minute and the stirring was stopped to obtain a toner composition-dispersed suspension. While the obtained toner composition-dispersed suspension was stirred, the gaseous phase on the surface of the suspension was forcedly renewed at a constant temperature of 40° C. by an exhaust system. Such a state was kept for 17 hours and the solvent was removed. The reaction system was cooled to room temperature, and thereafter hydrochloric acid was added thereto to dissolve $Ca_3(PO4)_2$, followed by filtration, washing with water, drying and classifying to obtain toner particles. The hydrophobic fine silica powder was externally added to the obtained toner particles in the same manner as in Example 1 to obtain a toner 14.

The physical properties of the thus obtained toner 14 were shown in Table 3. The obtained toner was evaluated in the same manner as in Example 1, and the results were shown in Table 4.

Example 15

A toner 15 was obtained in the same manner as in Example 1 except that the materials used for producing the pigment-dispersed paste were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-8 | 1.13 parts |

Example 16

A toner 16 was obtained in the same manner as in Example 1 except that the materials used for producing the pigment-dispersed paste were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-9 | 1.13 parts |

Example 17

A toner 17 was obtained in the same manner as in Example 1 except that the materials used for producing the pigment-dispersed paste were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-10 | 1.13 parts |

Example 18

Preparation of Polyester P-4

| | |
|---|---|
| Bisphenol A • propylene oxide 2.2 mol adduct | 1200 parts |
| Bisphenol A • ethylene oxide 2.2 mol adduct | 475 parts |
| Terephthalic acid | 250 parts |
| Trimellitic anhydride | 190 parts |
| Fumaric acid | 300 parts |
| Dibutyltin oxide | 0.100 parts |

were charged into a 4-L four-necked glass flask, to which a thermometer, a stirring rod, a capacitor and a nitrogen-introducing tube were equipped, and the flask was placed into a mantle heater. The materials were allowed to react under a nitrogen atmosphere at 220° C. for 5 hours to obtain a polyester resin P-4.

Then,

| | |
|---|---|
| Polyester resin P-4 | 100 parts |
| Polymer A-11 | 2.00 parts |
| C.I. Pigment Blue 15:3 | 5.00 parts |
| Paraffin wax (HNP-7: manufactured by NIPPON SEIRO CO., LTD.) | 3.00 parts |

the above toner materials were sufficiently premixed by Henschel Mixer (Mitsui Miike Chemical Engineering Machinery Co., Ltd., and thereafter the mixture was melt-kneaded by a twin-screw extruder and cooled, and roughly pulverized by using a hammer mill to a particle diameter of about 1 to 2 mm. Then, the coarsely pulverized product was finely pulverized by a fine pulverizer using an air jet technique. Further, the obtained finely pulverized product was classified by a multi classifier to obtain toner particles.

One part of the hydrophobic silica fine powder having a BET of 200 $m^2/g$ based on 100 parts of the above toner particles was externally added by Henschel Mixer to obtain a toner 18. The physical properties of the obtained toner were shown in Table 3. The obtained toner was evaluated in the same manner as in Example 1, and the results were shown in Table 4.

Example 19

A toner 19 was obtained in the same manner as in Example 1 except that the materials used for producing the pigment-dispersed paste were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-12 | 1.13 parts |

Example 20

A toner 20 was obtained in the same manner as in Example 1 except that the materials used for producing the pigment-dispersed paste were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 1.13 parts |
| Polymer B-1 | 1.59 parts |

Example 21

A toner 21 was obtained in the same manner as in Example 1 except that the materials used for producing the pigment-dispersed paste were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 1.13 parts |
| Polymer B-1 | 0.0450 parts |

Example 22

A toner 22 was obtained in the same manner as in Example 1 except that the materials used for producing the pigment-dispersed paste were changed as follows and the amount of the pigment-dispersed paste to be used for producing a monomer mixture was changed to 45.15 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 1.50 parts |
| Polymer B-1 | 0.12 parts |

Example 23

A toner 23 was obtained in the same manner as in Example 1 except that the materials used for producing the pigment-dispersed paste were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 1.13 parts |
| Polymer B-2 | 1.50 parts |

Example 24

A toner 24 was obtained in the same manner as in Example 1 except that the materials used for producing the pigment-dispersed paste were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 1.13 parts |
| Polymer B-3 | 1.50 parts |

Example 25

A toner 25 was obtained in the same manner as in Example 24 except that the polymer B-3 in Example 24 was changed to the polymer B-4. The physical properties of the obtained toner were shown in Table 3. The obtained toner was evaluated in the same manner as in Example 1, and the results were shown in Table 4.

Example 26

A toner 26 was obtained in the same manner as in Example 24 except that the polymer B-3 in Example 24 was changed to the polymer B-5. The physical properties of the obtained toner were shown in Table 3. The obtained toner was evaluated in the same manner as in Example 1, and the results were shown in Table 4.

Example 27

A toner 27 was obtained in the same manner as in Example 24 except that the polymer B-3 in Example 24 was changed to the polymer B-6. The physical properties of the obtained toner were shown in Table 3. The obtained toner was evaluated in the same manner as in Example 1, and the results were shown in Table 4.

Example 28

A toner 28 was obtained in the same manner as in Example 1 except that the materials used for producing the pigment-dispersed paste were changed as follows and the amount of the pigment-dispersed paste to be used for producing a monomer mixture was changed to 44.9 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 0.300 parts |
| Polymer B-2 | 3.00 parts |

Example 29

A toner 29 was obtained in the same manner as in Example 1 except that the materials used for producing the pigment-dispersed paste were changed as follows and the amount of the pigment-dispersed paste to be used for producing a monomer mixture was changed to 44.9 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 0.150 parts |
| Polymer B-2 | 3.00 parts |

Example 30

A toner 30 was obtained in the same manner as in Example 1 except that the materials used for producing the pigment-dispersed paste were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-1 | 2.25 parts |
| Polymer B-1 | 0.0450 parts |

Example 31

A toner 31 was obtained in the same manner as in Example 1 except that the materials used for producing the pigment-dispersed paste were changed as follows and the amount of the pigment-dispersed paste to be used for producing a monomer mixture was changed to 45.0 parts. The physical properties of the obtained toner were shown in Table 3. The obtained toner was evaluated in the same manner as in Example 1, and the results were shown in Table 4.

Pigment-Dispersed Paste:

| | |
|---|---|
| Styrene | 58.5 parts |
| C.I. Pigment Blue 15:3 | 9.75 parts |
| Polymer A-1 | 2.70 parts |
| Polymer B-1 | 0.0450 parts |

Example 32

A toner 32 was obtained in the same manner as in Example 1 except that the materials used for producing the pigment-dispersed paste were changed as follows and the amount of the pigment-dispersed paste to be used for producing a monomer mixture was changed to 59.9 parts. The physical properties of the obtained toner were shown in Table 3. The obtained toner was evaluated in the same manner as in Example 1, and the results were shown in Table 4.

| | |
|---|---|
| Styrene | 67.5 parts |
| Carbon Black | 11.3 parts |
| Polymer A-1 | 1.13 parts |

Example 33

A toner 33 was obtained in the same manner as in Example 1 except that the materials used for producing the pigment-dispersed paste were changed as follows and the amount of the pigment-dispersed paste to be used for producing a monomer mixture was changed to 45.3 parts. The physical properties of the obtained toner were shown in Table 3. The obtained toner was evaluated in the same manner as in Example 1, and the results were shown in Table 4.

| | |
|---|---|
| Styrene | 58.5 parts |
| Quinacridone (C.I. Pigment Violet 19 | 9.75 parts |
| Polymer A-1 | 1.13 parts |

Example 34

A toner 34 was obtained in the same manner as in Example 1 except that the materials used for producing the pigment-dispersed paste were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-14 | 1.13 parts |

Example 35

A toner 35 was obtained in the same manner as in Example 1 except that the materials used for producing the pigment-dispersed paste were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-15 | 1.13 parts |

Example 36

A toner 36 was obtained in the same manner as in Example 1 except that the materials used for producing the pigment-dispersed paste were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-16 | 1.13 parts |

Example 37

A toner 37 was obtained in the same manner as in Example 1 except that the materials used for producing the pigment-dispersed paste were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-17 | 1.13 parts |

Example 38

A toner 38 was obtained in the same manner as in Example 1 except that the materials used for producing the pigment-dispersed paste were changed as follows. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-18 | 1.13 parts |

Comparative Example 1

A toner 39 was obtained in the same manner as in Example 1 except that the materials used for producing the pigment-dispersed paste were changed as follows and the amount of the pigment-dispersed paste to be used for producing a monomer mixture was changed to 45.2 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer B-2 | 1.50 parts |

Comparative Example 2

A toner 40 was obtained in the same manner as in Example 1 except that the materials used for producing the pigment-dispersed paste were changed as follows and the amount of the pigment-dispersed paste to be used for producing a monomer mixture was changed to 44.6 parts. The physical properties of the obtained toner were shown in Table 3. The obtained toner was evaluated in the same manner as in Example 1, and the results were shown in Table 4.

| | |
|---|---|
| Styrene | 58.5 parts |
| C.I. Pigment Blue 15:3 | 9.75 parts |
| Polymer A-13 | 4.50 parts |

TABLE 3

| | Name of toner | Type of polymer | | Parts charged based on 100 parts of binder resin | | Content in toner particles (μmol/g) | | Content ratio of structures "a" and "b" in toner | Particle size distribution |
|---|---|---|---|---|---|---|---|---|---|
| | | Polymer A | Polymer B | Polymer A | Polymer B | Structure "a" | Structure "b" | x/y | D4/D1 |
| Example 1 | Toner 1 | Polymer A-1 | — | 0.750 | 0.00 | 2.35 | 0.00 | — | 1.16 |
| Example 2 | Toner 2 | Polymer A-2 | — | 0.750 | 0.00 | 2.26 | 0.00 | — | 1.17 |
| Example 3 | Toner 3 | Polymer A-3 | — | 0.750 | 0.00 | 2.28 | 0.00 | — | 1.18 |
| Example 4 | Toner 4 | Polymer A-1 | — | 0.0250 | 0.00 | 0.0769 | 0.00 | — | 1.19 |
| Example 5 | Toner 5 | Polymer A-1 | — | 0.0750 | 0.00 | 0.238 | 0.00 | — | 1.19 |
| Example 6 | Toner 6 | Polymer A-4 | — | 0.750 | 0.00 | 9.75 | 0.00 | — | 1.24 |
| Example 7 | Toner 7 | Polymer A-5 | — | 1.25 | 0.00 | 0.082 | 0.00 | — | 1.12 |
| Example 8 | Toner 8 | Polymer A-5 | — | 6.00 | 0.00 | 0.38 | 0.00 | — | 1.18 |
| Example 9 | Toner 9 | Polymer A-6 | — | 1.500 | 0.00 | 0.15 | 0.00 | — | 1.20 |
| Example 10 | Toner 10 | Polymer A-7 | — | 0.750 | 0.00 | 194 | 0.00 | — | 1.19 |
| Example 11 | Toner 11 | Polymer A-1 | — | 0.600 | 0.00 | 2.29 | 0.00 | — | 1.28 |
| Example 12 | Toner 12 | Polymer A-7 | — | 20.0 | 0.00 | 220 | 0.00 | — | 1.22 |
| Example 13 | Toner 13 | Polymer A-7 | — | 17.0 | 0.00 | 192 | 0.00 | — | 1.25 |
| Example 14 | Toner 14 | Polymer A-1 | — | 1.20 | 0.00 | 2.32 | 0.00 | — | 1.26 |
| Example 15 | Toner 15 | Polymer A-8 | — | 0.750 | 0.00 | 2.35 | 0.00 | — | 1.16 |
| Example 16 | Toner 16 | Polymer A-9 | — | 0.750 | 0.00 | 4.15 | 0.00 | — | 1.17 |
| Example 17 | Toner 17 | Polymer A-10 | — | 0.750 | 0.00 | 2.30 | 0.00 | — | 1.18 |
| Example 18 | Toner 18 | Polymer A-11 | — | 2.00 | 0.00 | 8.82 | 0.00 | — | 1.27 |
| Example 19 | Toner 19 | Polymer A-12 | — | 0.750 | 0.00 | 1.96 | 0.00 | — | 1.15 |
| Example 20 | Toner 20 | Polymer A-1 | Polymer B-1 | 0.750 | 1.06 | 2.37 | 2.09 | 1.18 | 1.22 |
| Example 21 | Toner 21 | Polymer A-1 | Polymer B-1 | 0.750 | 0.0300 | 2.35 | 0.0584 | 42.1 | 1.19 |
| Example 22 | Toner 22 | Polymer A-1 | Polymer B-1 | 1.00 | 0.0800 | 3.14 | 0.161 | 20.4 | 1.20 |
| Example 23 | Toner 23 | Polymer A-1 | Polymer B-2 | 0.750 | 1.00 | 2.34 | 3.68 | 0.663 | 1.25 |
| Example 24 | Toner 24 | Polymer A-1 | Polymer B-3 | 0.750 | 1.00 | 2.34 | 3.92 | 0.623 | 1.24 |
| Example 25 | Toner 25 | Polymer A-1 | Polymer B-4 | 0.750 | 1.00 | 2.34 | 2.18 | 1.12 | 1.22 |
| Example 26 | Toner 26 | Polymer A-1 | Polymer B-5 | 0.750 | 1.00 | 2.34 | 4.05 | 0.603 | 1.26 |
| Example 27 | Toner 27 | Polymer A-1 | Polymer B-6 | 0.750 | 1.00 | 2.34 | 3.77 | 0.647 | 1.25 |
| Example 28 | Toner 28 | Polymer A-1 | Polymer B-2 | 0.200 | 2.00 | 0.623 | 3.94 | 0.165 | 1.26 |
| Example 29 | Toner 29 | Polymer A-1 | Polymer B-2 | 0.100 | 3.00 | 0.307 | 3.94 | 0.0816 | 1.30 |
| Example 30 | Toner 30 | Polymer A-1 | Polymer B-1 | 1.50 | 0.0300 | 4.68 | 0.110 | 44.9 | 1.17 |

TABLE 3-continued

| | Name of toner | Type of polymer | | Parts charged based on 100 parts of binder resin | | Content in toner particles (μmol/g) | | Content ratio of structures "a" and "b" in toner | Particle size distribution |
|---|---|---|---|---|---|---|---|---|---|
| | | Polymer A | Polymer B | Polymer A | Polymer B | Structure "a" | Structure "b" | x/y | D4/D1 |
| Example 31 | Toner 31 | Polymer A-1 | Polymer B-1 | 1.80 | 0.0300 | 5.61 | 0.110 | 53.9 | 1.19 |
| Example 32 | Toner 32 | Polymer A-1 | — | 0.750 | 0.00 | 2.34 | 0.00 | — | 1.15 |
| Example 33 | Toner 33 | Polymer A-1 | — | 0.750 | 0.00 | 2.35 | 0.00 | — | 1.16 |
| Example 34 | Toner 34 | Polymer A-14 | — | 0.750 | 0.00 | 2.28 | 0.00 | — | 1.17 |
| Example 35 | Toner 35 | Polymer A-15 | — | 0.750 | 0.00 | 2.39 | 0.00 | — | 1.15 |
| Example 36 | Toner 36 | Polymer A-16 | — | 0.750 | 0.00 | 2.44 | 0.00 | — | 1.16 |
| Example 37 | Toner 37 | Polymer A-17 | — | 0.750 | 0.00 | 2.47 | 0.00 | — | 1.17 |
| Example 38 | Toner 38 | Polymer A-18 | — | 0.750 | 0.00 | 2.34 | 0.00 | — | 1.15 |
| Comparative Example 1 | Toner 39 | — | Polymer B-2 | 0.00 | 1.00 | 0.00 | 3.70 | 0.00 | 1.40 |
| Comparative Example 2 | Toner 40 | Polymer A-13 | — | 3.00 | 0.00 | 9.19 | 0.00 | — | 1.32 |

TABLE 4

| | Name of toner | Degree of aggregation % | | Fluidity | Saturated charge amount (mC/kg) | Charge amount distribution | Rise of charging (%) |
|---|---|---|---|---|---|---|---|
| | | Externally added product | After left under extreme conditions (40° C., 95%, 10 days) | | | | |
| Example 1 | Toner 1 | 32.9 | 35.1 | A | −108 | A | 82 |
| Example 2 | Toner 2 | 35.3 | 42.3 | B | −103 | A | 83 |
| Example 3 | Toner 3 | 37.3 | 39.8 | A | −112 | A | 80 |
| Example 4 | Toner 4 | 32.7 | 33.8 | A | −89 | A | 80 |
| Example 5 | Toner 5 | 33.5 | 35.4 | A | −100 | A | 81 |
| Example 6 | Toner 6 | 37.1 | 39.6 | A | −121 | B | 80 |
| Example 7 | Toner 7 | 33.7 | 35.6 | A | −82 | A | 81 |
| Example 8 | Toner 8 | 32.9 | 34.1 | A | −89 | A | 83 |
| Example 9 | Toner 9 | 31.8 | 33.4 | A | −87 | A | 83 |
| Example 10 | Toner 10 | 37.2 | 39.3 | A | −118 | A | 80 |
| Example 11 | Toner 11 | 38.9 | 46.5 | B | −82 | B | 76 |
| Example 12 | Toner 12 | 38.5 | 50.1 | C | −120 | B | 77 |
| Example 13 | Toner 13 | 37.4 | 46.5 | B | −112 | B | 75 |
| Example 14 | Toner 14 | 37.8 | 45.2 | B | −87 | B | 79 |
| Example 15 | Toner 15 | 33.3 | 37.5 | A | −100 | A | 79 |
| Example 16 | Toner 16 | 32.8 | 35.6 | A | −102 | A | 81 |
| Example 17 | Toner 17 | 35.7 | 38.2 | A | −102 | A | 82 |
| Example 18 | Toner 18 | 39.4 | 45.1 | B | −86 | B | 81 |
| Example 19 | Toner 19 | 33.7 | 39.1 | B | −99 | A | 82 |
| Example 20 | Toner 20 | 37.8 | 42.9 | B | −144 | A | 95 |
| Example 21 | Toner 21 | 35.4 | 39.2 | A | −110 | A | 84 |
| Example 22 | Toner 22 | 33.5 | 38.8 | B | −123 | A | 88 |
| Example 23 | Toner 23 | 36.3 | 42.7 | B | −160 | A | 96 |
| Example 24 | Toner 24 | 36.8 | 44.7 | B | −132 | A | 95 |
| Example 25 | Toner 25 | 36.5 | 45.7 | B | −155 | A | 92 |
| Example 26 | Toner 26 | 35.2 | 43.5 | B | −128 | A | 87 |
| Example 27 | Toner 27 | 37.8 | 47.5 | B | −138 | A | 87 |
| Example 28 | Toner 28 | 38.0 | 46.3 | B | −130 | A | 85 |
| Example 29 | Toner 29 | 37.6 | 46.2 | B | −125 | A | 85 |
| Example 30 | Toner 30 | 36.8 | 39.6 | A | −120 | A | 88 |
| Example 31 | Toner 31 | 38.2 | 43.6 | B | −125 | A | 85 |
| Example 32 | Toner 32 | 33.4 | 36.1 | A | −106 | A | 82 |
| Example 33 | Toner 33 | 34.2 | 35.6 | A | −107 | A | 83 |
| Example 34 | Toner 34 | 34.3 | 36.2 | A | −105 | A | 80 |
| Example 35 | Toner 35 | 35.5 | 38.1 | A | −100 | A | 79 |
| Example 36 | Toner 36 | 33.3 | 37.2 | A | −103 | A | 82 |

TABLE 4-continued

| | Name of toner | Degree of aggregation % Externally added product | After left under extreme conditions (40° C., 95%, 10 days) | Fluidity | Saturated charge amount (mC/kg) | Charge amount distribution | Rise of charging (%) |
|---|---|---|---|---|---|---|---|
| Example 37 | Toner 37 | 36.1 | 39.4 | A | −102 | A | 81 |
| Example 38 | Toner 38 | 34.6 | 37.1 | A | −105 | A | 81 |
| Comparative Example 1 | Toner 39 | 32.6 | 43.4 | C | −162 | C | 70 |
| Comparative Example 2 | Toner 40 | 38.7 | 54.3 | E | −98 | C | 80 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-111719, filed May 18, 2011, hereby incorporated by reference herein in its entirety.

REFERENCE SIGN LIST

1 suction unit
2 measuring container
3 screen
4 cover
5 vacuum gauge
6 air volume-regulating valve
7 suction port
8 capacitor
9 electrometer

The invention claimed is:

1. A toner comprising toner particles, each of which contains a binder resin, a colorant and a charge controlling agent, wherein:

the charge controlling agent is a polymer A having a structure "a" represented by formula (1), and the polymer A has a weight average molecular weight (Mw) of not less than 1,000 and not more than 100,000:

Formula (1)

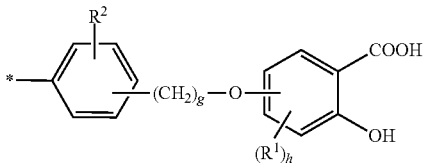

wherein $R^1$ represents a hydroxyl group, a carboxyl group, an alkyl group having not less than 1 and not more than 18 carbon atoms, or an alkoxyl group having not less than 1 and not more than 18 carbon atoms, $R^2$ represents a hydrogen atom, a hydroxyl group, an alkyl group having not less than 1 and not more than 18 carbon atoms, or an alkoxyl group having not less than 1 and not more than 18 carbon atoms, g represents an integer of not less than 1 and not more than 3 and h represents an integer of not less than 0 and not more than 3, wherein when h is 2 or 3, $R^1$ can be each independently selected, and

* represents a binding site in the polymer A.

2. The toner according to claim 1, where the structure "a" is contained in the polymer A as a partial structure represented by the following formula (2):

Formula (2)

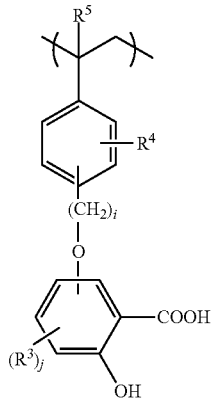

wherein $R^3$ represents a hydroxyl group, a carboxyl group, an alkyl group having not less than 1 and not more than 18 carbon atoms, or an alkoxyl group having not less than 1 and not more than 18 carbon atoms, $R^4$ represents a hydrogen atom, a hydroxyl group, an alkyl group having not less than 1 and not more than 18 carbon atoms, or an alkoxyl group having not less than 1 and not more than 18 carbon atoms, $R^5$ represents a hydrogen atom or a methyl group, i represents an integer of not less than 1 and not more than 3 and j represents an integer of not less than 0 and not more than 3, wherein when j is 2 or 3, $R^3$ can be each independently selected.

3. The toner according to claim 1, wherein a content of the structure "a" in the polymer A is not less than 10 μmol/g and not more than 1500 μmol/g.

4. The toner according to claim 1, wherein a content of the structure "a" in the toner is not less than 0.10 μmol/g and not more than 200 μmol/g.

5. The toner according to claim 1, further containing a polymer B having a structure "b" represented by formula (3), as the charge controlling agent:

Formula (3)

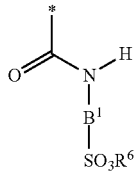

wherein $B^1$ represents an alkylene structure that may have a substituent and that has 1 or 2 carbon atoms, or an aromatic ring that may have a substituent, $R^6$ represents a hydrogen atom or an alkyl group having not less than 1 and not more than 12 carbon atoms, the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms, and the substituent in the aromatic ring is a hydroxyl group, an alkyl group having not less than 1 and not more than 12 carbon atoms, or an alkoxyl group having not less than 1 and not more than 12 carbon atoms.

6. The toner according to claim 5, wherein the structure "b" is contained in the polymer B as a partial structure represented by formula (4):

Formula (4)

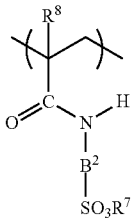

wherein $B^2$ represents an alkylene structure that may have a substituent and that has 1 or 2 carbon atoms, or an aromatic ring that may have a substituent, $R^7$ represents a hydrogen atom or an alkyl group having not less than 1 and not more than 12 carbon atoms, $R^8$ represents a hydrogen atom or a methyl group, the substituent in the alkylene structure is a hydroxyl group, an alkyl group having not less than 1 and not more than 12 carbon atoms, an aryl group having 6 or 12 carbon atoms, or an alkoxyl group having not less than 1 and not more than 12 carbon atoms, and the substituent in the aromatic ring is a hydroxyl group, an alkyl group having not less than 1 and not more than 12 carbon atoms, or an alkoxyl group having not less than 1 and not more than 12 carbon atoms.

7. The toner according to claim 5, wherein a sulfur content in the toner is 0.10 μmol/g or more, and a molar ratio, x/y, of the content x (μmol/g) of the structure "a" contained in the toner to a content y (μmol/g) of the structure "b" contained in the toner is not less than 0.10 and not more than 50.

8. The toner according claim 1, wherein:

the toner is obtained by granulating a composition containing the colorant, the releasing agent and the charge controlling agent in an aqueous medium.

* * * * *